US005680147A

United States Patent [19]

Yamazaki et al.

[11] Patent Number: 5,680,147

[45] Date of Patent: Oct. 21, 1997

[54] ELECTRO-OPTICAL DEVICE AND METHOD OF DRIVING THE SAME

[75] Inventors: Shunpei Yamazaki, Tokyo; Akira Mase, Aichi; Masaaki Hiroki; Yasuhiko Takemura, both of Kanagawa, all of Japan

[73] Assignee: Semiconductor Energy Laboratory Co., Ltd., Kanagawa, Japan

[21] Appl. No.: 885,637

[22] Filed: May 19, 1992

[30] Foreign Application Priority Data

| | | | |
|---|---|---|---|
| May 20, 1991 | [JP] | Japan | 3-145642 |
| May 20, 1991 | [JP] | Japan | 3-145643 |
| May 31, 1991 | [JP] | Japan | 3-157502 |
| May 31, 1991 | [JP] | Japan | 3-157505 |

[51] Int. Cl.[6] ..... G09G 3/36

[52] U.S. Cl. ..... 345/94; 345/92

[58] Field of Search ..... 340/784, 719, 340/811, 793, 805; 359/58, 59; 345/94, 95, 96, 98, 99, 100, 103, 87, 90, 92, 93, 208, 209, 210, 89; 349/33, 34, 41, 42

[56] References Cited

U.S. PATENT DOCUMENTS

| | | | |
|---|---|---|---|
| 3,653,745 | 4/1972 | Mao | 340/784 |
| 4,062,626 | 12/1977 | Kawakami et al. | 340/784 |
| 4,082,430 | 4/1978 | Scholthess et al. | 340/784 |
| 4,485,380 | 11/1984 | Soneda et al. | 340/784 |
| 4,511,926 | 4/1985 | Crossland et al. | 359/59 |
| 4,630,122 | 12/1986 | Morokawa | 340/784 |
| 4,680,580 | 7/1987 | Kawahara | 340/719 |
| 4,818,077 | 4/1989 | Ohwada | 359/59 |
| 4,851,827 | 7/1989 | Nicholas | 340/719 |
| 4,938,565 | 7/1990 | Ichikawa | 359/59 |
| 4,962,413 | 10/1990 | Yamazaki et al. | 359/59 |
| 5,157,386 | 10/1992 | Uchida et al. | 340/793 |
| 5,165,075 | 11/1992 | Hiroki et al. | 359/59 |
| 5,170,155 | 12/1992 | Plus et al. | 340/805 |
| 5,227,900 | 7/1993 | Inaba et al. | 340/784 |

FOREIGN PATENT DOCUMENTS

| | | | |
|---|---|---|---|
| 0144297 | 12/1978 | Japan | 359/59 |
| 3287235 | 12/1991 | Japan | 359/59 |

*Primary Examiner*—Xiao Wu

*Attorney, Agent, or Firm*—Sixbey, Friedman, Leedom & Ferguson, P.C.; Gerald J. Ferguson, Jr.

[57] ABSTRACT

An electro-optical device and a method of fine gradation display by an electro-optical device are disclosed. In case of driving each picture element of the active matrix type electro-optical device, a visual gradation display can be carried out by using transfer gate complementary field effect transistors, in a structure where one of the input and output terminals thereof is connected with a picture element electrode, by applying a voltage to the other terminal, and by applying a bipolar pulse to a control electrode at a certain timing and cutting the voltage at the same time, and whereby controlling the time for applying voltage to the picture element, while a visual gradation display can also be carried out in a structure where one of the input and output terminals of the device is connected with the picture element, by applying the bipolar pulse to the control electrode at a certain timing and by applying a voltage as a function of time to the other terminal at the same time, and whereby applying the voltage determined thereby to the picture element.

30 Claims, 13 Drawing Sheets nTFT
A-A' CROSS SECTION
pTFT
B-B' CROSS SECTION

13
①
22

9
②
21

18
20

10
12
11
61
③
19

66
④
65

⑥
72
71
⑤

⑦
17
50

ELECTRO-OPTICAL DEVICE AND METHOD OF DRIVING THE SAME

BACKGROUND OF THE INVENTION

1. Field of the Invention

The present invention relates to an electro-optical device, and to a method of driving an electro-optical device. The present invention relates to the method of gradation image display of an electro-optical device for setting a clear gradation level through the generation of certain level of voltage at an output terminal by applying a voltage that is varied in its magnitude as time passes, or an analog signal, to one input terminal of an active device, while by applying a signal voltage for control, or a digital signal, to the other input terminal, at a controlled timing. The present invention also relates to the method of gradation image display by the electro-optical device, for setting a clear gradation level by applying an analog or digital signal voltage to one input terminal of the active device, while by applying a signal voltage for control to the other input terminal, at a controlled timing, and whereby controlling a duration of voltage application to the output terminal.

2. Description of the Prior Art

A liquid crystal composition can easily be oriented in a parallel direction or in a vertical direction to the electric field existing outside thereof, for the dielectric constant of the liquid crystal composition differs in its parallel direction and in vertical direction to a molecular axis. The ON/OFF display of a liquid crystal electro-optical device is carried out by taking advantage of the anisotropy in the dielectric constant, and whereby controlling the amount of transmitted light or the degree of light dispersion. As a liquid crystal material, twisted nematic (TN) liquid crystal, super-twisted nematic (STN) liquid crystal, ferroelectric liquid crystal (FLC), antiferroelectric liquid crystal (AFLC), and polymer liquid crystal (also referred to as dispersion type liquid crystal) are conventionally known, as well as the liquid crystal display comprising these.

FIG. 8 shows an example of the electro-optical characteristic of a nematic liquid crystal which is typically used as a liquid crystal material. The amount of transmitted light changes as voltage is changed; the amount of transmitted light is approximately 0% at a point A where an applied voltage Va is small, and approximately 20% at a point B of a voltage Vb, while the amount of transmitted light is approximately 70% at a point C of a voltage Vc, and it is 100% at a point D of a voltage Vd. Namely, a two-graded display in black and white is achieved by utilizing points A and D alone, while an intermediate gradation display is possible by utilizing only the rising points of the electro-optical characteristic, i.e. points B and C.

A conventional method of gradation display by a liquid crystal electro-optical device utilizing thin film transistor (TFT) has been carried out by using a TFT as an active device, and by normally using either N-channel TFT (NTFT) or P-channel TFT (PTFT), in the structure where a source or drain electrode was connected to one of the picture element electrodes, and by changing the voltage applied to the gate of TFT or that applied between the source and drain, and whereby adjusting the voltage applied to a liquid crystal in analog mode.

The above-mentioned method is, however, largely dependent on the threshold voltage of TFT or on the thickness of a gate insulating film, and so on. When the liquid crystal electro-optical device is actually manufactured, variation in TFT characteristics will be very large; in case of using a liquid crystal electro-optical device having picture elements of 640×480 dots, to be used for a normal computer display device, it was almost impossible to suppress the variation in characteristics of all the TFTs that amount to total 300,000 pieces in the liquid crystal electro-optical device, in 10%. Conventional method of gradation display was thus limited to 16-gradation.

BRIEF SUMMARY OF THE INVENTION

An object of the present invention is to propose a completely novel method of gradation display which has been conventionally difficult. Particularly, in a liquid crystal electro-optical device utilizing a thin film transistor (hereinafter referred to as TFT) as a switching device for driving according to the present invention, an image having an intermediate tone and brightness is displayed by the method of gradation display in accordance with the present invention. The gradation display in accordance with the present invention is carried out by using transfer gate complementary field effect thin film transistors (CMOSTFTs) as an active device for driving a picture element, and by applying a high-speed signal to the active device at a controlled timing, and whereby controlling the magnitude or duration of the voltage applied to the picture element, according to the timing.

DETAILED DESCRIPTION OF THE PREFERRED EMBODIMENTS

The present invention is characterized by adopting a completely innovative method of image display for clarifying the voltage level applied to a liquid crystal, not by applying an uncertain analog value to a gate, or between source and drain, in a conventional way, but by applying a universal voltage which is varied as time passes by in a certain cycle, to a picture element including TFT, and by converting an image information signal into digital pulse, which is applied to an input terminal such as a gate, at an appropriate timing, and whereby applying an aimed voltage to the liquid crystal.

Further, the present invention is characterized by adopting a completely innovative method of image display, for achieving intermediate gradation display, by utilizing the fact that the intermediate gradation display is possible by means of an effective voltage applied to a picture element, and by controlling a time for applying a substantially digital voltage without practically no analog element, to the picture element.

Figure 5:
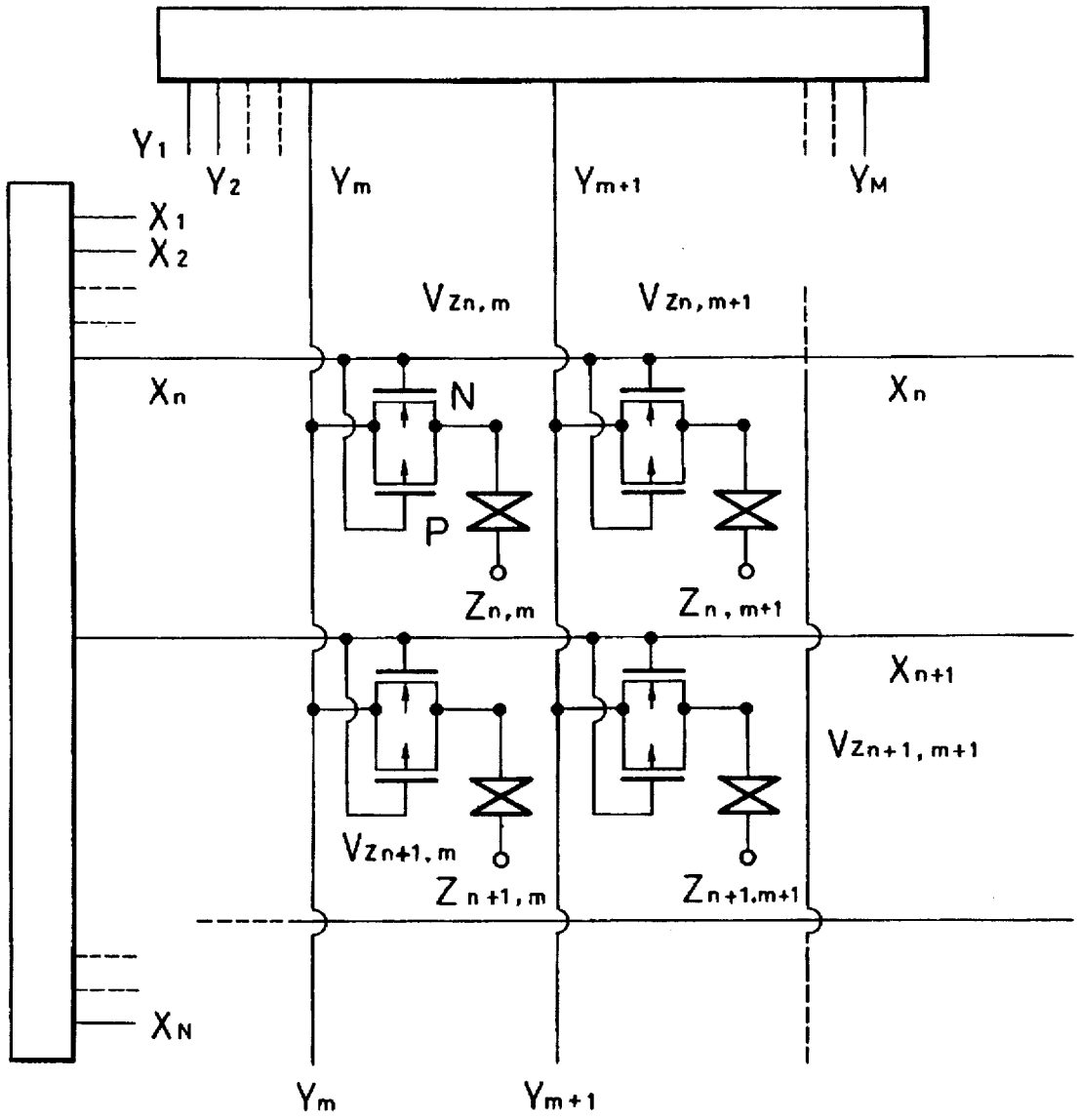
FIG. 5 shows an example of a matrix form in accordance with the present invention.
Figure 6:
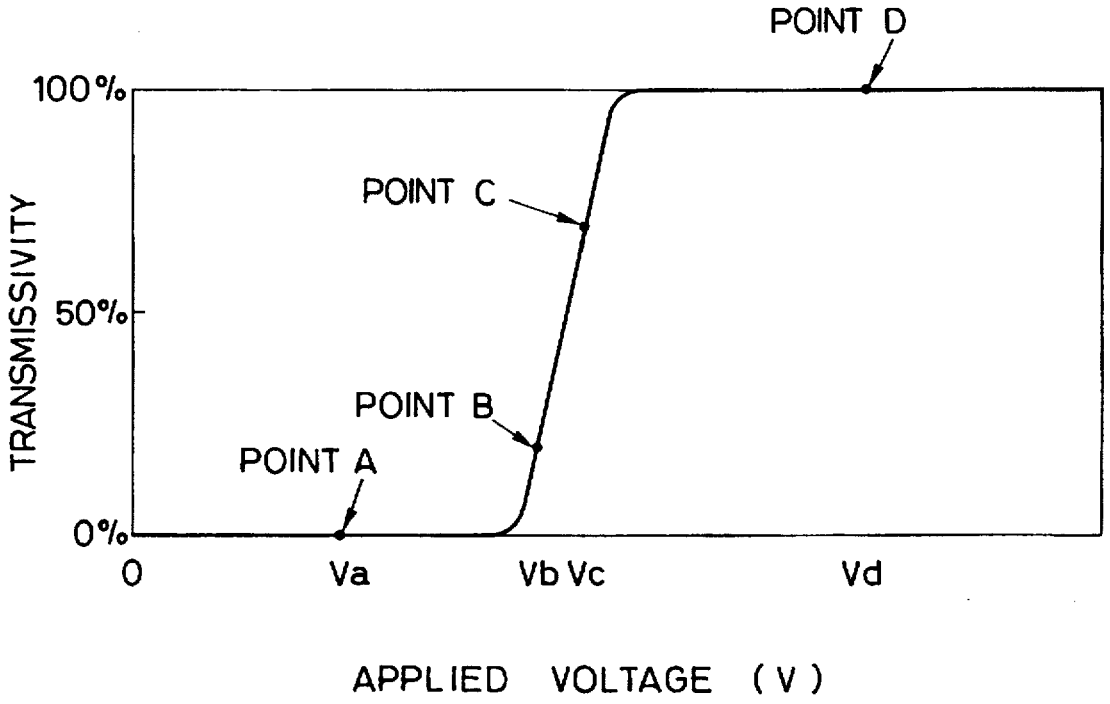
FIG. 6 shows an electro-optical characteristic of a nematic liquid crystal.

FIG. 5 shows an example of a circuit of an active matrix of the liquid crystal display device necessary for the embodiment of the present invention. Since it is required for an active device to respond in such a short time as not more than 100 nsec, according to the present invention, a circuit which is actuated at high velocity, must be assembled. A modified transfer gate circuit structure should thus be used, in which an N-channel thin film transistor (NTFT) and a P-channel type thin film transistor (PTFT) are complementarily operated, as shown in the FIG. 5, rather than either NTFT only or PTFT only as in a conventional way.

A matrix of N-column and M-row is formed in this example, however, since only the vicinity of the element of n-column and m-row in the matrix is shown in FIG. 5, so as to eliminate complexity, a complete version will be obtained by developing the same figures vertically and horizontally.

As shown in the figure, in which four modified transfer gates are described, the source of each modified transfer gate is connected to $Y_m$ or to $Y_{m+1}$ (hereinafter referred to collectively as Y-line (address signal line)), while each gate electrode of PTFT and NTFT of the modified transfer gate are bonded with each other (this one in the connected condition is hereinafter referred simply as the gate of modified transfer gate), and are connected with $X_n$ or to $X_{n+1}$ (hereinafter referred to collectively as X-line (data signal line)). The drain of the modified transfer gate is connected with liquid crystal picture elements $Z_{n,m}$, $Z_{n,m+1}$, $Z_{n+1,m}$, $Z_{n+1,m+1}$. Since NTFT and PTFT are located symmetrically in the modified transfer gate, their positions can be reversed.

A capacitor, which is not shown in the figure, may be artificially inserted in parallel to the picture element which works as a capacitor. The capacitor thus inserted will bring the effect that suppresses the reduction in voltage of the picture element through natural discharge. The capacity of the capacitor to be artificially inserted should be approximately several to hundred times as large as the capacity of the picture element capacitor, or preferably two to ten times as large as the same, for the existence of excessive capacity will hinder a high-speed operation, to which the present invention aims, and by which the present invention is characterized.

Figure 1:
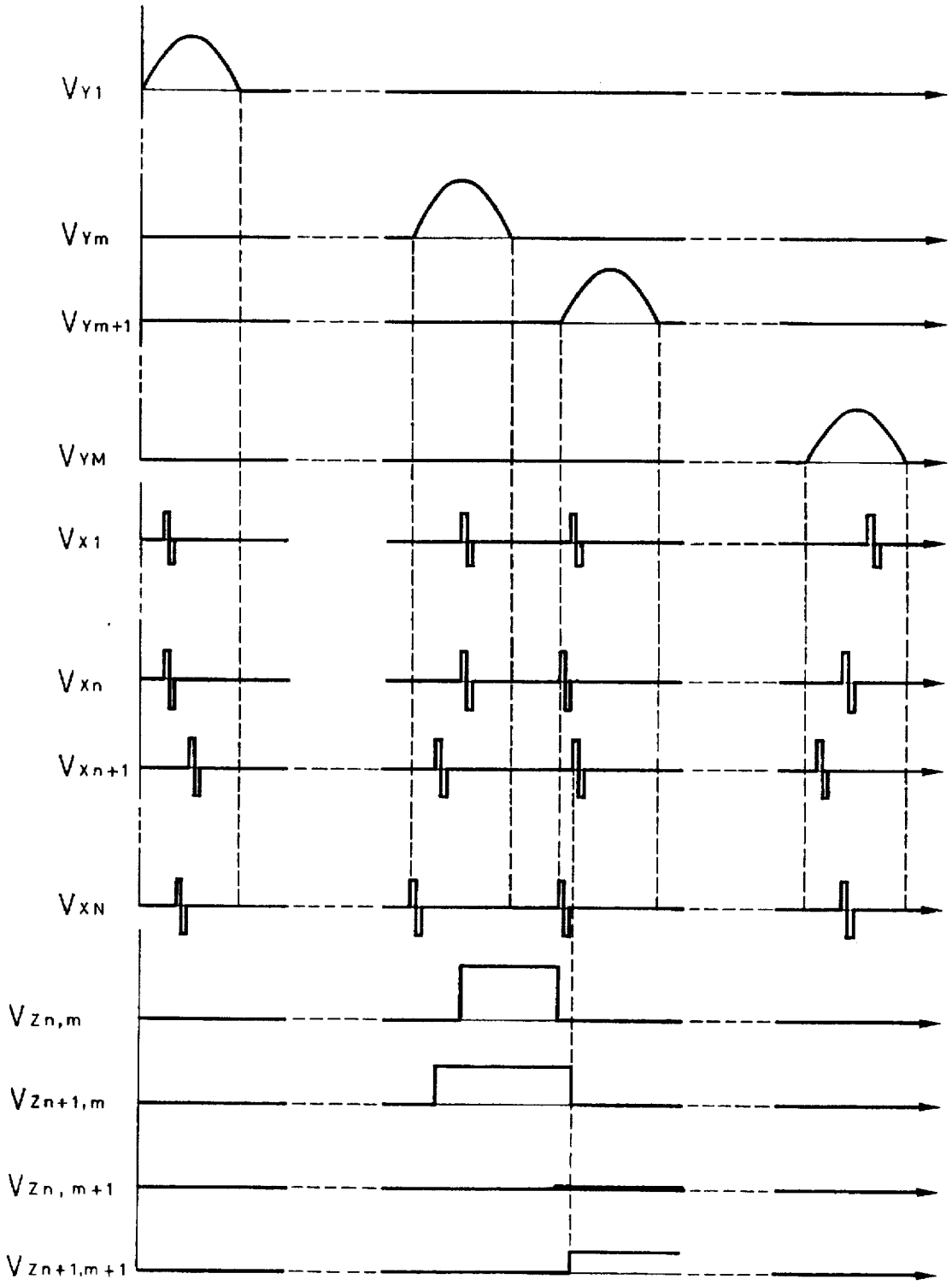
FIG. 1 shows one drive waveform in accordance with the present invention.

The operational example of the circuit when actually used, is described in FIG. 1, in which $V_{Ym}$ and $V_{Xn}$ mean electric potentials to be applied to $Y_m$ and $X_n$, respectively, while $V_{Zn,m}$ means an electric potential on the TFT side of the liquid crystal picture element $Z_{n,m}$ shown in the FIG. 5. When the electric potential of the counter electrode of the liquid crystal picture element is defined as 0V, for the purpose of simplification, $V_{Zn,m}$ thus means the voltage applied to the liquid crystal picture element.

A half-wave of sine wave (cosine wave) as shown in FIG. 1 is first applied to a $Y_1$ line. While the sine wave is continued, a pulse signal which is inverted in its polarity (hereinafter referred to as bipolar pulse) is applied to each X-line intentionally at a controlled timing, as shown in the figure.

It is observed that no voltage is applied to any liquid crystal picture elements, at the time, namely, $Z_{n,m}$, $Z_{n,m+1}$, $Z_{n+1,m}$, $Z_{n+1,m+1}$, from the inspection of these picture elements. This is because the voltage is supplied to neither $Y_m$ nor $Y_{m+1}$. At this stage, the picture element to which any voltage is possibly applied, is that in a first row, i.e. $Z_{11}$, $Z_{21}$, ... $Z_{N1}$. The half-wave of the same kind as mentioned above is then applied to $Y_2$, and a bipolar pulse is applied again to each X-line. At this time, voltage is applied to the picture element in a second row, and the image of the second row can thus be obtained.

Voltage is applied in turn, in this manner, until it is applied to $Y_m$, while a bipolar pulse is applied to the X-line, however, the timing or the starting time of the pulse for applying to each X-line is not the same. For example, the pulse is applied to $X_{n+1}$ earlier than to $X_n$. The voltage of a Y-line when the pulse is applied thus becomes the output voltage of the modified transfer gate, by which the capacitor of the liquid crystal picture element is charged. Consequently, the voltage of the picture element $Z_{n+1,m}$ is smaller than that of the picture element $Z_{n,m}$. The time required for charging the capacitor of the liquid crystal picture element is neglected here, however, the time constants of TFT and of the capacitor are practically around several nsec at most, whereas the width of the bipolar pulse is several hundreds nsec, which can fairly be neglected.

A sine wave voltage is then applied to $Y_{m+1}$, while a bipolar pulse is applied to the X-line, and the charge accumulated in the picture elements $Z_{n,m}$ and $Z_{n+1,m}$ is discharged, as observed from the inspection thereof. Since voltage is applied to the gate, whereas no voltage is applied to $Y_m$, the charge is leaked from the liquid crystal picture element to $Y_m$ on application of the voltage. Voltage has been applied to $Y_{m+1}$ at the time, and charge is accumulated thereby in picture elements $Z_{n,m+1}$ and $Z_{n+1,m+1}$, as shown in the figure.

In this manner, voltage is applied in turn up until $Y_M$, and one screen (also referred to as frame) is thus formed. It is to be noted that an image is displayed in a dynamic mode in which the image appears one by one in each row and disappears when another image in a following row appears. It is possible, however, to prevent the loss of charge by connecting a diode to the transfer gate in series, and whereby obtaining a static mode such as a normal active matrix. It is also possible to retain the charge of the liquid crystal picture element by, for example, connecting the capacitor made of ferroelectric substance to the liquid crystal picture element in parallel, and by utilizing the hysteresis of the electrostatic characteristic proper to the ferroelectric substance.

Figure 3:
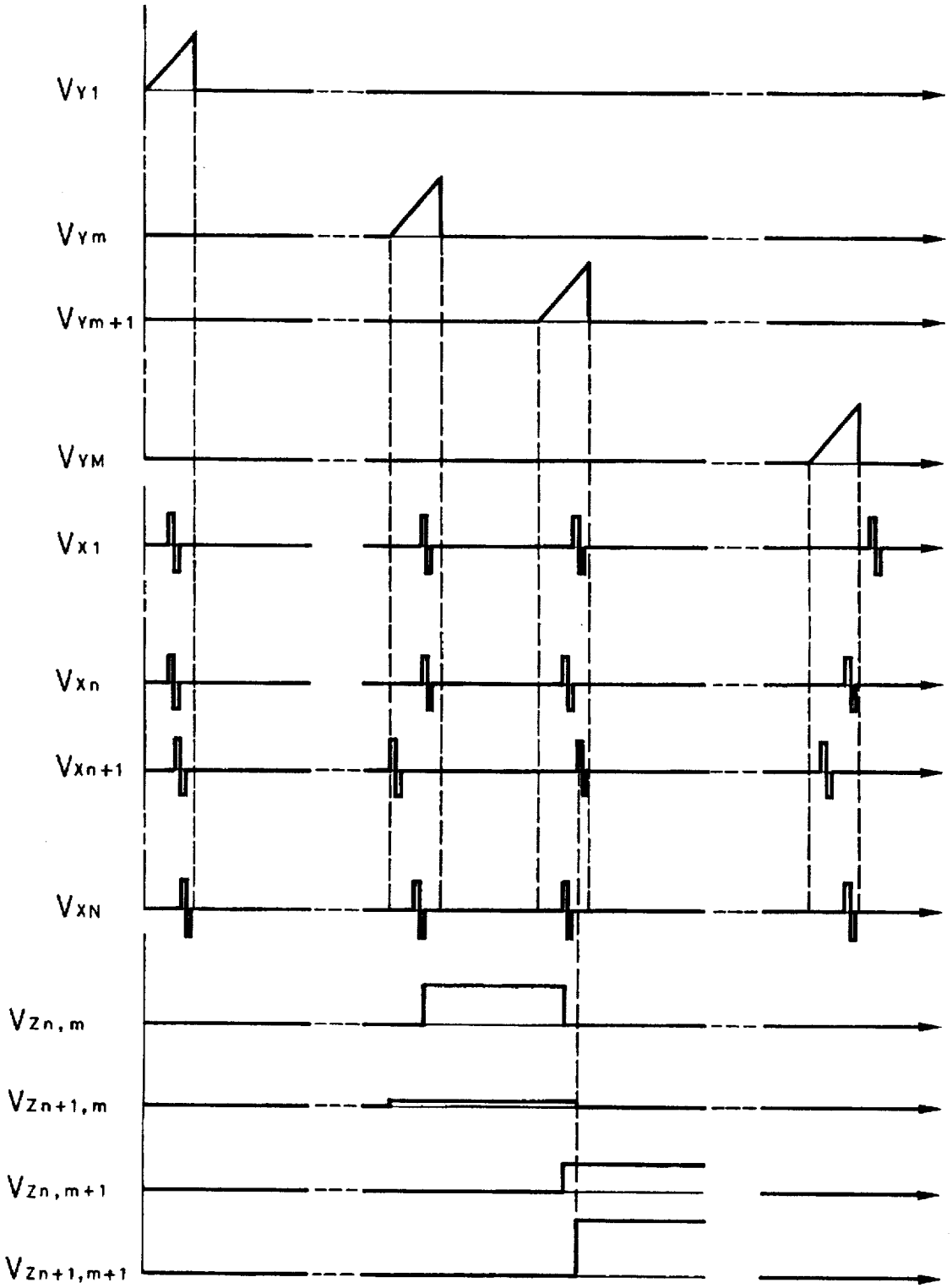
FIG. 3 shows an example using another drive waveform in accordance with the present invention.

Gradation display can be carried out as explicated above, and its accuracy is supposed to be of almost the same as the duration of the signal voltage applied to the Y-line divided by the width of the bipolar pulse. In a strict sense, however, the nonlinear feature observed in the electric characteristic of a liquid crystal must be taken into consideration, as shown in FIG. 3. The time required for the formation of one screen is supposed to be generally around 30 msec. According to the example shown in FIG. 1, the time required means a period from the application of voltage to $Y_1$, through the voltage application to $Y_M$, to the re-application of voltage to $Y_1$. In order to achieve 256-gradation by a display device having 480 rows, or M=480, while the time per screen is defined 30 msec, the rate of bipolar pulse must be 250 nsec, where voltage is continued on liquid crystal over several tens microsec.

In the driving method of FIG. 1, the sine wave (cosine wave) is applied to Y-lines, however, a chopping wave or a ramp wave can be applied to Y-lines instead in accordance with the present invention.

Figure 2:
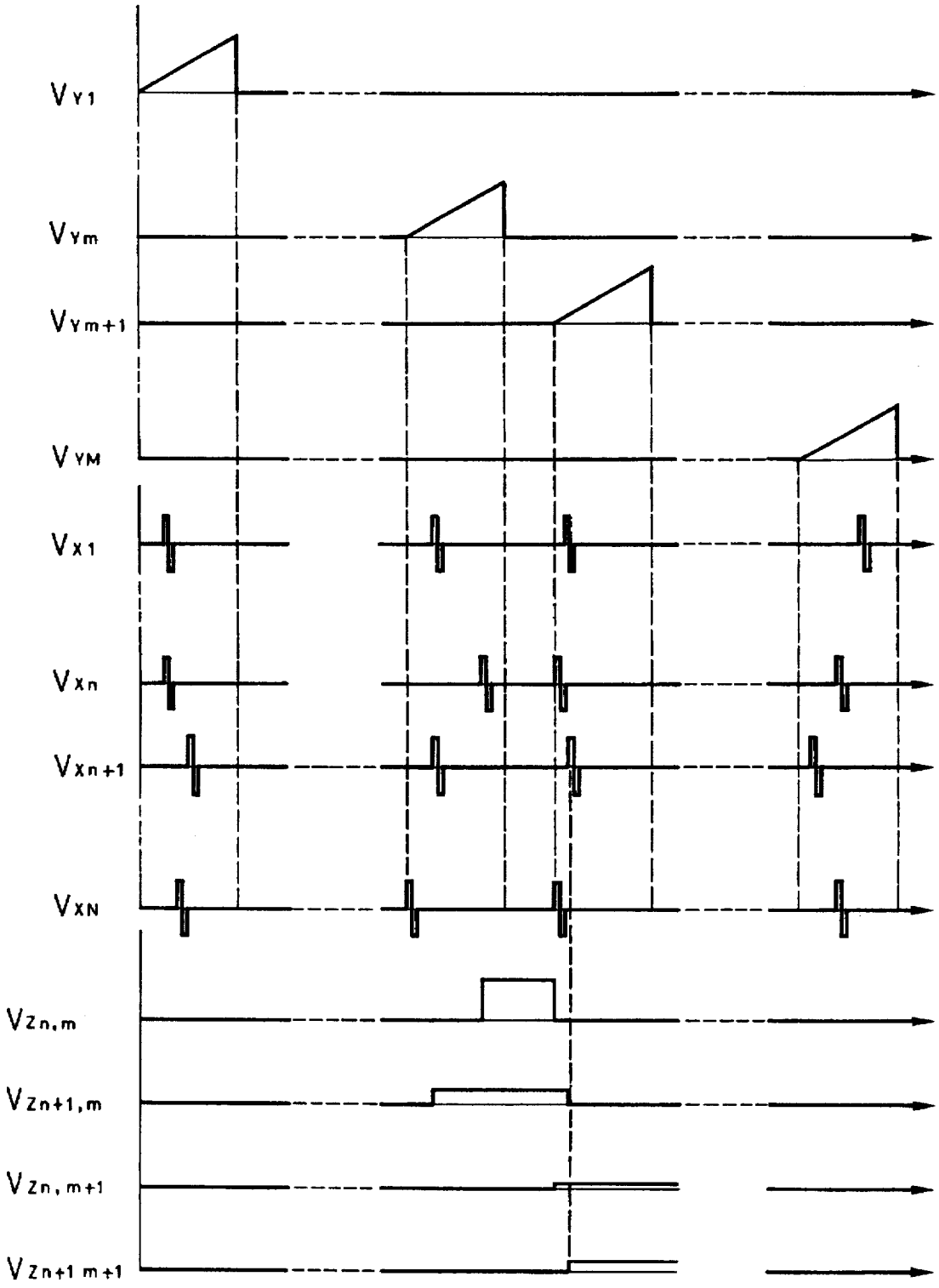
FIG. 2 shows an example using another drive waveform in accordance with the present invention.

Another drive waveform for the embodiment of the present invention is shown in FIG. 2, in which a ramp waveform is used instead of the sine wave shown in FIG. 1. The ramp waveform has not only simple structure but also an advantage of easy conversion of a gradation data into Δt. The detail of this mechanism, which is almost the same as explained in FIG. 1, will be omitted here. The analog voltage applied to the picture element can be digitally controlled by the drive waveform shown in FIG. 2, in the same manner as shown in FIG. 1. Although the voltage applied to a picture element $Z_{n+1,m}$ is low, for example, the duration of voltage application thereto is long, whereas the voltage applied to a picture element $Z_{n,m}$ is higher, and the duration thereof is still shorter than in the case of the picture element $Z_{n+1,m}$. For this reason, the visual difference in brightness between the picture elements $Z_{n+1,m}$ and $Z_{n,m}$ is sometimes smaller than expected. In order to surmount this difficulty, the duration of no voltage application to any of Y-line should be larger than that of voltage application thereto as shown in FIG. 3. When the duration of non-application is set to the same level as that of voltage application, for example, the maximum duration of voltage application to each picture element is three times as long as the minimum duration of application, in theory, or almost twice as long as the minimum duration, in practice. Further, when the duration of non-application of voltage to any Y-lines is set twice as long as the duration of application, as shown in FIG. 3, voltage will be applied to the picture element $Z_{n,m}$ longer only by 40% compared to the case of the picture element $Z_{n,m+1}$. The error in visual brightness due to the difference in the duration of voltage application to a picture element, can largely be improved, regardless of the level of the voltage applied to the picture element.

In the driving methods of FIGS. 1 to 3, a reference signal whose signal level varies during duration of the reference signal is applied to the Y-line $Y_m$ with no signal applied to the Y-lines other than the Y-line $Y_m$ during duration of the reference signal, and a bipolar signal comprising two pulses having opposite polarities is applied to each of the X-lines $X_1$ to $X_N$ during duration of the reference signal. In the driving methods of FIGS. 1 to 3, the reference signal is first applied only to a Y-line $Y_1$, next applied only to a Y-line $Y_2$, then applied only to a Y-line $Y_m$, and then applied only to a Y-line $Y_M$.

Figure 4:
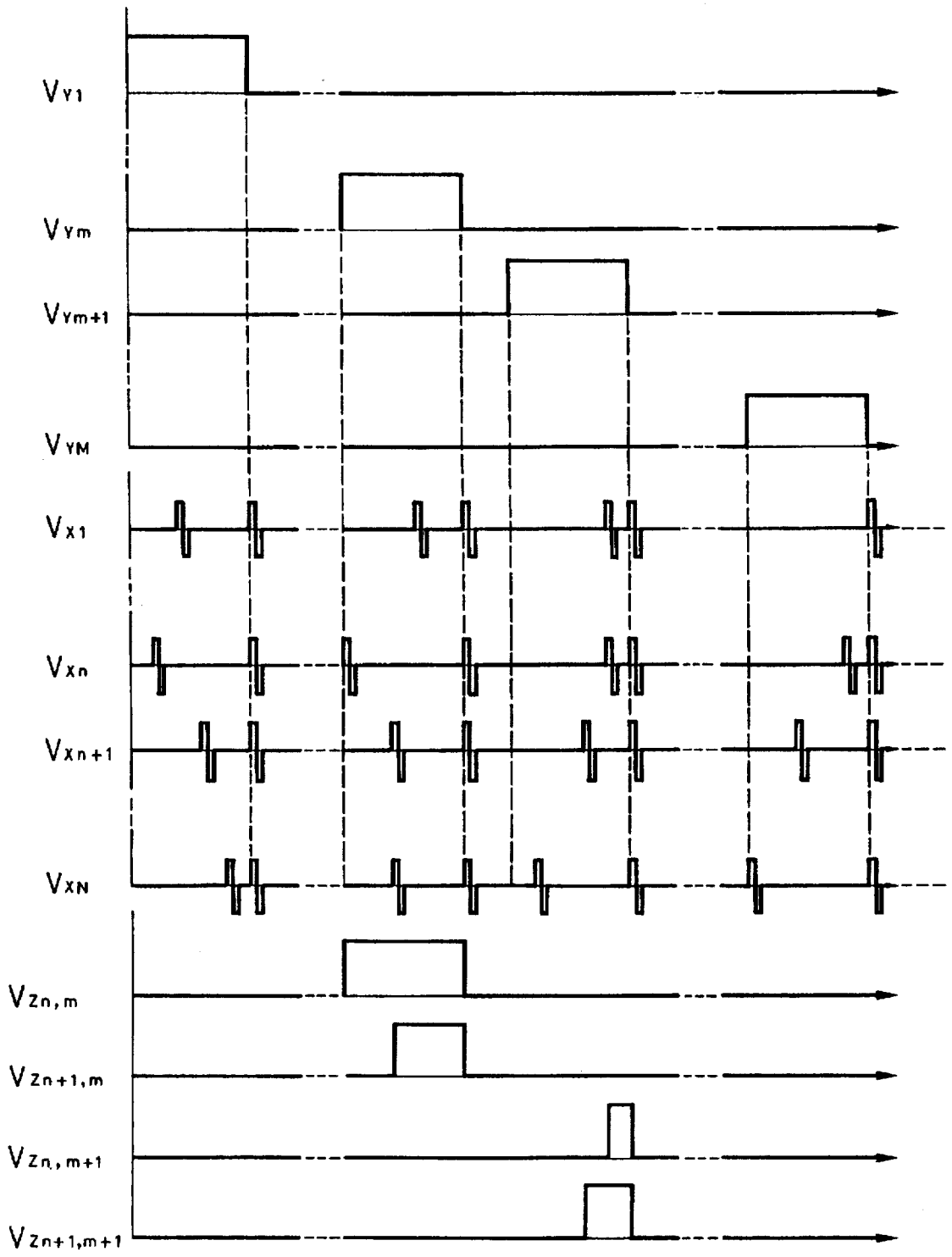
FIG. 4 shows an example using another drive waveform in accordance with the present invention.

Another drive waveform is shown in FIG. 4 with regard to the intermediate gradation display in accordance with the present invention. A rectangular pulse as shown in FIG. 4 is first applied to a $Y_1$ line. Although it is easier in this case to utilize the signal that is not changed in voltage level during pulse continuation, such as the rectangular pulse, as a signal voltage of Y-line, this fact does not negate a possible utilization of the signal voltage (reference signal) such as a sine wave, a cosine wave, a chopping wave or a ramp wave. The bipolar pulse as shown in the figure is intentionally applied to each X-line at a controlled timing during the continuation of the rectangular pulse.

When picture elements $Z_{n,m}$, $Z_{n,m+1}$, $Z_{n+1,m}$, and $Z_{n+1,m+1}$ are inspected at the time, no voltage is applied to any picture element. This is because the voltage is not supplied to either $Y_m$ or $Y_{m+1}$. At this stage, only the picture element in the first row is actuated, in the same way as in the preceding example. The rectangular pulse of the same kind is also applied to $Y_2$, while bipolar pulse is applied to each X-line. Voltage is thus applied in turn, until the rectangular pulse is applied to $Y_m$. The bipolar pulse is applied to X-line at a controlled timing, in the same manner. Namely, the timing or the starting time for the pulse to be applied to each X-line is not the same. The pulse is applied to $X_n$ earlier than to $X_{n+1}$, for example. The capacitor of the picture element is charged on the application of the pulse, and the voltage is thereby applied to the picture element. Consequently, voltage is applied to the picture element $Z_{n,m}$ earlier than the picture element $Z_{n+1,m}$. The condition where voltage is applied to the picture element is finished by the application of the bipolar pulse to all of the X-lines, after the rectangular pulse of $Y_m$ is finished. Since no voltage is applied to any Y-line at the time, the charge accumulated in the picture element is discharged, and the voltage of the picture element thus becomes zero.

A pulse voltage is then applied to $Y_{m+1}$. A bipolar pulse is applied to X-line in the same manner. Since the voltage is applied to $Y_{m+1}$ at the time, charge is accumulated in the picture elements $Z_{n,m+1}$, and $Z_{n+1,m+1}$, as shown in the figure, and the condition where voltage is applied is continued for a limited period of time for each.

In this manner, voltage is applied in turn up until $Y_M$, and one frame is formed thereby. In this case also, an image is displayed in a dynamic mode in principle, in the same way as the examples shown in FIGS. 1 through 3.

Gradation display is carried out, as explicated in the foregoing examples. The accuracy of the gradation is also supposed to be the same level as the duration of the signal voltage applied to Y-line divided by the width of bipolar pulse. Since the time required for the formation of one frame is supposed to be around 30 msec, the width of the bipolar pulse should be no more than 250 nsec, in order to achieve 256 gradations in the example shown in FIG. 4 where M=480.

In practice, the timing for applying bipolar pulse is limited by a basic clock inputted to a driver IC that is directly connected to the electro-optical device according to the present invention. Namely, since the drive frequency is product of the number of scanning lines (X lines), the number of frames and the number of gradations, when the liquid crystal display device has 640×400 dots and is driven at 60 per second of the number of frames and the driver IC comprises CMOS transistors having a drive frequency of about 20 MHz, the maximum number of gradations is calculated to be 416 by dividing 20 MHz by (400×60). It goes without saying that 832-gradation is possible by dividing the display screen into upper and lower two parts to halve the number of scanning lines, while obtaining the maximum gradations twice as large as that is also possible by reducing the number of frames to 30.

Further, it is also effective to achieve a larger number of gradations by speeding up drive signal. At the time, high-speed operation of no less than 20 MHz is possible by forming a part or all of the drive circuit of each picture element on an insulator substrate.

The foregoing description is made by the use of the voltage level and the zero level for purpose of simplification. However, this level is not necessarily zero since these levels can be defined as that not more than a threshold of TFT or electro-optical material such as a liquid crystal and that not less than said threshold, respectively, in the present invention.

In FIG. 4, a reference signal is applied to a Y-line $Y_m$ with no signal applied to the other Y-lines during duration of the reference signal, and a bipolar signal comprising two pulses having opposite polarities is applied to each of X-lines $X_1$ to $X_N$ during the duration of the reference signal, and a bipolar signal comprising two pulses having opposite polarities is applied to each of the X-lines $X_1$ to $X_N$ when a signal having a low voltage level (no signal) is applied to each of the Y-lines $Y_1$ to $Y_M$. In the driving method of FIG. 4, the reference signal is first applied only to a Y-line $Y_1$, next applied only to a Y-line $Y_2$, then applied only to a Y-line $Y_m$, and then applied only to a Y-line $Y_M$.

Although there is not detailed description about the bipolar pulse, the height, width, and polarity and so on thereof are changeable in design according to the device required, and it will be clear that no limit is set to these values in the present invention. Namely, the shape of the bipolar pulse is not in question in the present invention, no matter which signal, positive or negative, comes first, and these signals can be combined in terms of space and time, for the same device. The widths of the bipolar pulses of different polarities are not necessarily the same; a positive pulse can be wider while a negative pulse can be narrower, and vice versa, according to the difference in mobilities of NTFT and PTFT. The same rule applies to the height of pulse: a positive pulse can be higher while a negative one lower, and vice versa. These detailed values are decided depending on the device required.

Although there was no description in the explanation supra concerning the alternating method which has been conventionally used, the present invention does not negate the alternating method, and it will be no obstruction to the implementation of the present invention.

It will be clear that the pulse may have a reverse polarity, since the voltage described in the above explanation is a relative physical quantity (electric potential) with a certain point as a standard point (reference point). Further, although the electric potential of the counter electrode of the picture element is defined zero in the above explanation, a proper level of offset voltage can be applied to the counter electrode of the picture element. Although the screen was scanned one by one in line (row) in the above example, it goes without saying that the interlaced scanning, or the method of scanning every other lines, i.e. scanning first, third, and fifth lines (rows) at first, and then second, fourth, and sixth lines (rows), is possible.

The present invention is characterized by employing a digital gradation display, compared with a conventional way in a completely analog mode. Regarding its effectiveness, in case of using a liquid crystal electro-optical device having picture elements of 640×400 dots, it is extremely difficult to manufacture total amount of 256,000 of TFTs with no difference in characteristics, and the upper limit in practice is supposed to be 16 gradations display in consideration of mass productivity and yield, however, no less than 256 gradations display is possible in accordance with the present invention, by carrying out gradation display only through digital control, without applying any analog signal. Since it is thoroughly digital display, there is no ambiguities in gradation due to the difference in TFT characteristics, at all, and therefore, gradation display was carried out quite homogeneously, even though there is a little difference in TFTs. The yield of TFT is no more problematic in the present invention, and as a result, manufacturing cost was drastically reduced, compared with the conventional case where the yield is so bad when TFTs of little difference are to be obtained.

In case of carrying out normal analog gradation display by the liquid crystal electro-optical device comprising 256,000 groups of TFTs of 640×400 dots formed into a 300 mm square, 16 gradations display was an upper limit, for the difference in the TFT characteristics exists by approximately ±10%. In case of carrying out digital gradation display in accordance with the present invention, however, display is possible in as much as 256 gradations, since it is not easily affected by the difference in TFT characteristics, and as much as 16,777,216 colors of various, subtle tone display can be achieved in a color display mode. When a software such as a television picture is to be projected, even the "rocks" of the same color are subtly different in color tone due to the presence of fine recesses and the like. The display in colors as close to the nature as possible will hardly be achieved by 16-gradation. The variation in these fine color tones has now become possible by means of the gradation display in accordance with the present invention.

Although the case using 30–60 frames was considered in the above explanation, which is the proper number normally used at present, this does not limit the number of frames to these values. The number of frames is essentially not in question in the present invention, and quality of picture can be improved more by increasing the number of frames per unit time in the method of driving the electro-optical device in accordance with the present invention as quality of picture can be generally improved by increasing the number of frames per unit time. In the preferred embodiment of the present invention described below, explanation will center around the TFT utilizing silicon, however, the TFT utilizing germanium can be used in the same context. Since the characteristics of single crystalline germanium, in particular, excel those of single crystalline silicon, e.g. electron mobility of the former is 3600 $cm^2/Vs$, and its Hall mobility 1800 $cm^2/Vs$, compared with electron mobility of 1350 $cm^2/Vs$, and Hall mobility 480 $cm^2/Vs$, for the latter, thus the single crystalline germanium is a most suitable material for the present invention to execute high-speed operation. Germanium is suitable for a low temperature process since germanium is changed from amorphous state to crystalline state at a temperature lower than silicon. The ratio of nucleus generation during crystal growth is also small for germanium, thus a large crystal can generally be obtained by polycrystal growth. Germanium has excellent characteristics that are by no means inferior to those of silicon.

Although the explanation with regard to the technical idea of the present invention centered around an electro-optical device primarily utilizing liquid crystal, in particular, a display device, the device is not necessarily a display device in order to implement the idea; a projection-type television, a photo-switch, or a photo-shutter and the like, can be used. Further, it will be clear that the present invention can be implemented if an electro-optical material is changeable in its optical characteristic as a result of being electrically affected by electric field, voltage, and so on, and the material is not limited to liquid crystal. When a liquid crystal material is to be used as an electro-optical material in an electro-optical modulating layer provided between a pair of substrates according to the present invention, TN (twisted nematic) liquid crystal, STN (super twisted nematic) liquid crystal, ferroelectric liquid crystal, antiferroelectric liquid crystal, polymer liquid crystal, and the like, are suitable, though there is no reference to this matter in the above explanation. Besides these, a guest-host (GH) type liquid crystal, for example, can be used.

Examples of manufacturing methods of preferred embodiment are described infra.

PREFERRED EMBODIMENT 1

In this embodiment, a wall mounted television set was manufactured by using the liquid crystal device utilizing the circuit structure as shown in FIG. 5, which will be described infra. Polycrystalline silicon that received laser annealing was used for TFT at the time of manufacturing.

Figure 7:
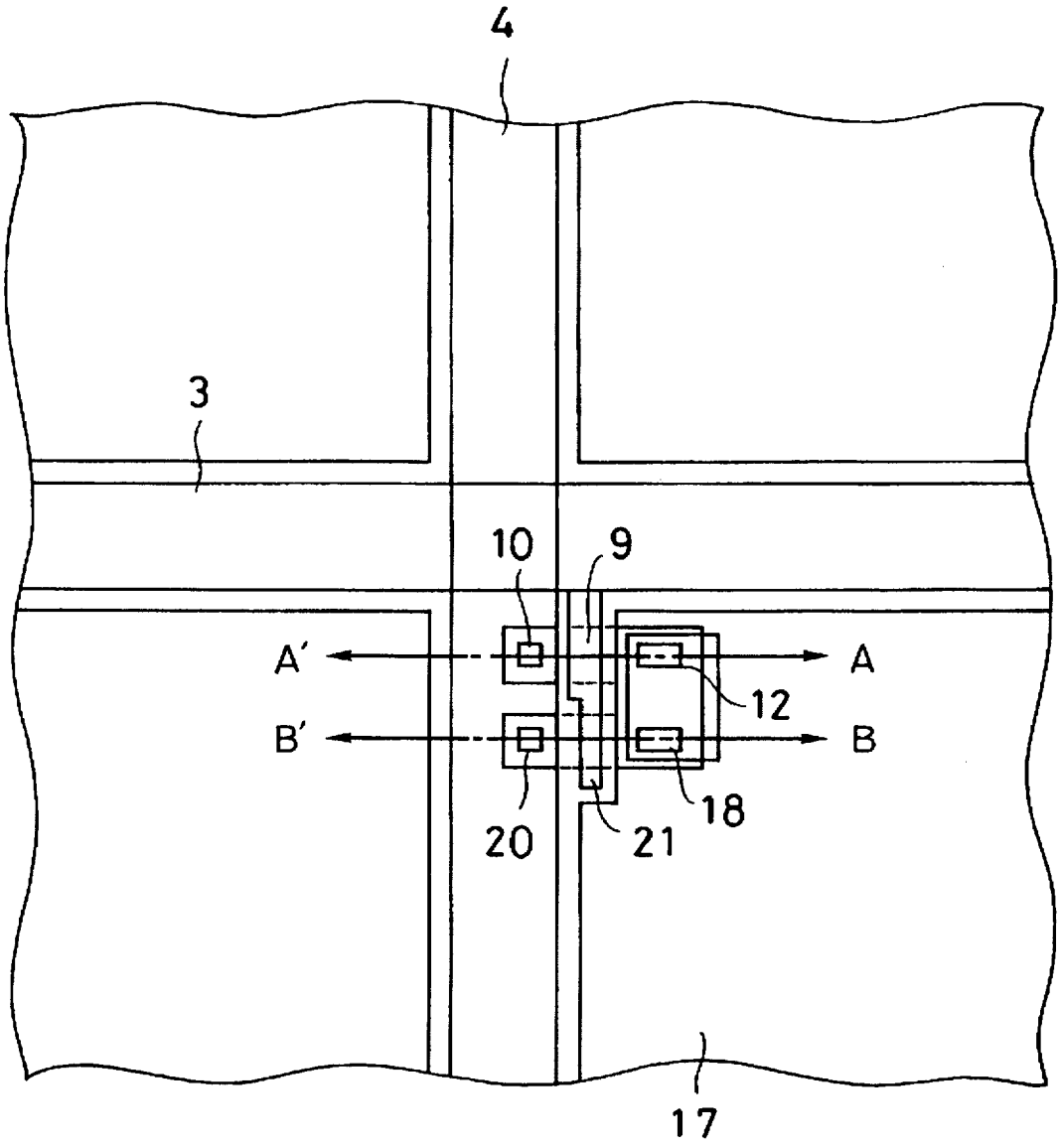
FIG. 7 shows a schematic diagram of a device in accordance with the preferred embodiment.
Figure 8A:
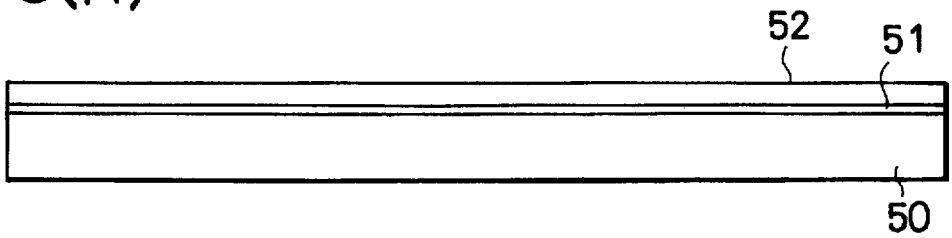
FIG. 8 shows a process of forming TFTs in accordance with the preferred embodiment.

The actual arrangement or structure of electrodes etc. corresponding to this circuit structure is shown in FIG. 7, for one picture element. The manufacturing method of the liquid crystal panel used in the first preferred embodiment will be first explained with reference to FIG. 8. Referring to FIG. 8(A), a silicon oxide film was manufactured at a thickness of 1000–3000 angstroms as a blocking layer 51 by magnetron RF (high frequency) sputtering, on a glass substrate 50, which is not expensive such as quartz, and which can bear the thermal treatment of no more than 700° C., for example, approximately 600° C., under the process conditions as follows: in a 100% oxygen atmosphere; the temperature of film formation was 15° C.; output was 400–800 W; and pressure was 0.5 Pa. The rate of film formation was 30–100 angstroms/minute when quartz or single crystalline silicon was used as a target.

A silicon film 52 was manufactured thereon by plasma CVD. The temperature for film formation was 250°–350° C., or 320° C. in this preferred embodiment, and mono-silane ($SiH_4$) was used. Besides mono-silane ($SiH_4$), disilane ($Si_2H_6$) or trisilane ($Si_3H_8$) may be used. These were introduced into a PCVD device at a pressure of 3 Pa, and the film was formed by applying high frequency power of 13.56 MHz. At the time, high frequency power should be 0.02–0.10 W/cm$^2$, or 0.055 W/cm$^2$ in this preferred embodiment. The flow rate of mono-silane ($SiH_4$) was 20 SCCM, and the rate of film formation was approximately 120 angstroms/minute at the time. Boron may be added to the film at a concentration of $1\times10^{15}$–$1\times10^{18}$ cm$^{-3}$ by means of diborane during the film formation, so as to set the threshold voltages (Vth) for PTFT and NTFT to almost an equal level. Sputtering or low pressure CVD may be employed instead of the plasma CVD for the formation of the silicon layer which will be a channel region of TFT, which will be described below in a simplified manner.

In case of sputtering, a single crystalline silicon was used as a target, and the sputtering was carried out in the atmosphere of 20–80% of hydrogen mixed with argon, with the back pressure before sputtering defined no more than $1\times10^{-5}$ Pa: e.g. 20% of argon and 80% of hydrogen; the temperature for film formation was 150° C.; frequency was 13.56 MHz; sputtering output was 400–800 W; and, pressure was 0.5 Pa.

In case of employing low pressure CVD, disilane ($Si_2H_6$) or trisilane ($Si_3H_8$) was supplied to a CVD device, at a temperature of 450°–550° C., 100°–200° C. lower than the temperature of crystallization, e.g. at 530° C. The pressure in a reactor was 30–300 Pa, while the rate of film formation was 50–250 angstroms/minute. Boron may be added to the film at a concentration of $1\times10^{15}$–$1\times10^{18}$ cm$^{-3}$ by means of diborane during the film formation, so as to set the threshold voltages (Vth) for PTFT and NTFT to almost an equal level.

Oxygen concentration in the film formed in this way is preferably not more than $5\times10^{21}$ cm$^{-3}$. The oxygen concentration should be no more than $7\times10^{19}$ cm$^{-3}$, or preferably no more than $1\times10^{19}$ cm$^{-3}$, in order to promote crystallization, however if the concentration is too low, leakage current in an OFF condition is increased due to the illumination of a back light, whereas, if the concentration is too high, crystallization will not be facilitated, and the temperature or time for laser annealing must be higher or longer thereby. The concentration of hydrogen was $4\times10^{20}$ cm$^{-3}$, which was one atom % for the silicon at a concentration $4\times10^{22}$ cm$^{-3}$.

Oxygen concentration should be not more than $7\times10^{19}$ cm$^{-3}$ or preferably not more than $1\times10^{19}$ cm$^{-3}$, so as to promote crystallization for source or drain, while oxygen may be ion-implanted only into the region that forms a channel of TFT constituting a pixel, at a concentration of $5\times10^{20}$–$5\times10^{21}$ cm$^{-3}$.

The silicon film in an amorphous state was formed at a thickness of 500–5000 angstroms, or 1000 angstroms in this preferred embodiment, in the manner described above.

Figure 8B:
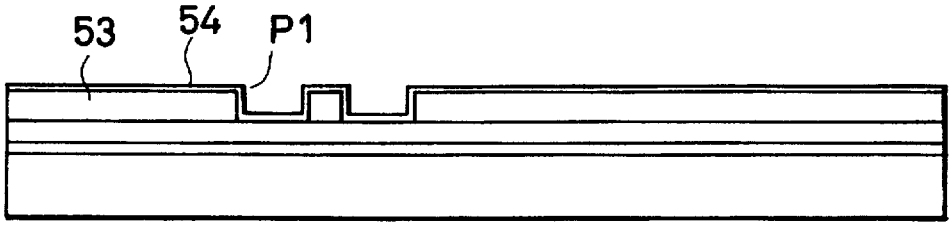
Figure 8C:
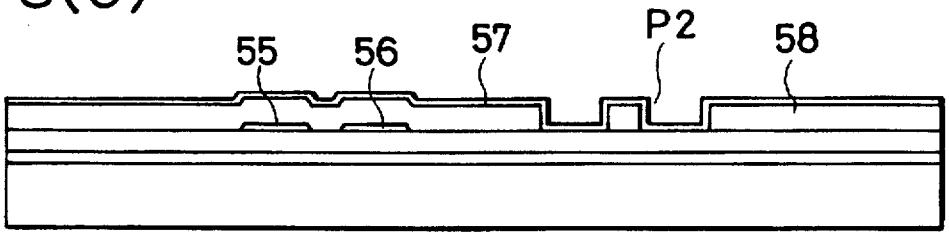
Figure 8D:
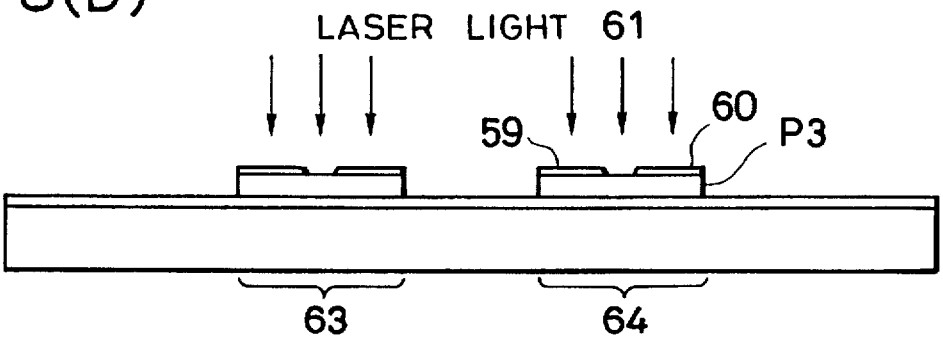

Patterning was carried out for a photoresist 53 using a mask P1 so as to open only the region for source or drain as shown in FIG. 8(B). A silicon film 54 was manufactured thereon as an n-type activation layer, by plasma CVD, at the temperature of film formation 250° C.–350° C., e.g. 320° C. in the preferred embodiment 1, and mono-silane ($SiH_4$) and phosphine ($PH_3$) of mono-silane base at a concentration of 3% were used. These were introduced into the PCVD device at a pressure of 5 Pa, and the film was formed by applying high frequency power of 13.56 MHz. The high frequency power should be 0.05–0.20 W/cm$^2$, e.g. 0.120 W/cm$^2$ in the preferred embodiment 1.

The specific electric conductivity of the n-type silicon layer thus formed was approximately $2\times10^{-1}$ [$\Omega\cdot$cm$^{-1}$], while film thickness was 50 angstroms. The resist 53 was then removed using a lift-off method, and source and drain regions 55 and 56 were formed.

A p-type activation layer was formed in the same process. Mono-silane ($SiH_4$) and diborane ($B_2H_6$) of mono-silane base at a concentration of 5% were introduced in the PCVD device at the time at a pressure of 4 Pa, and the film was formed by applying high frequency power of 13.56 MHz. The high frequency power should be 0.05–0.20 W/cm$^2$, e.g. 0.120 W/cm$^2$ in the preferred embodiment 1. The specific electric conductivity of the p-type silicon layer thus formed was approximately $5\times10^{-2}$ [$\Omega\cdot$cm$^{-1}$], while the film thickness was 50 angstroms. Source and drain regions 59 and 60 were then formed by the lift-off method in the same way as for the N-type region. The silicon film 52 was thereafter etched off using a mask P3, and an island region 63 for N-channel thin film transistor and an island region 64 for P-channel thin film transistor were formed thereby.

The source, drain and channel regions were laser-annealed by XeCl excimer laser, and the activation layer was laser-doped at the same time. The threshold energy of the laser energy employed at the time was 130 mJ/cm$^2$, and 220 mJ/cm$^2$ is necessary as the laser energy in order to melt the film throughout thickness of the film. If the energy of no less than 220 mJ/cm$^2$ is irradiated from the start, however, hydrogen included in the film will be abruptly ejected, and the film will be damaged thereby. Thus the melting must be carried out only after hydrogen is first ejected at a low energy. In the first preferred embodiment, crystallization was carried out at an energy of 230 mJ/cm$^2$, after hydrogen was first purged out at 150 mJ/cm$^2$.

The silicon film was transformed from the amorphous structure into the state of higher order through the annealing, and a part thereof was observed as in a crystal state. A relatively higher order region of the silicon coated film, in particular, tends to be crystallized into a crystalline region by the annealing. However, silicon atoms are pulled with each other since bonds are formed between such regions by silicon atoms existing therebetween. According to the results of the measurement by Laser Raman Spectroscopy, a peak is observed as shifted to the lower frequency compared with a single crystal silicon peak, i.e. 522 cm$^{-1}$. The apparent grain diameter thereof is calculated 50–500 angstroms, based on a half band width, however, actually, a number of high crystallinity regions constituting cluster structure are formed to anchor clusters to each other by bond between silicons in the film.

As a result, it can be said that substantially no grain boundary (hereinafter referred to as "GB") exists in the film. Since carriers can easily move between each cluster, through the anchored points, a carrier mobility will be higher compared with that of a poly-crystalline silicon in which a GB obviously exists. Namely, Hall mobility (μh) is 10–200 $cm^2$/VSec; and, electron mobility (μe) is 15–300 $cm^2$/VSec.

A silicon oxide film was formed as a gate insulating film thereon at a thickness 500–2000 angstroms, e.g. 1000 angstroms, under the same condition as for the silicon oxide film manufactured as a blocking layer. A small amount of fluorine may be added thereto at the time of film formation, so as to stabilize sodium ion.

Figure 8E:
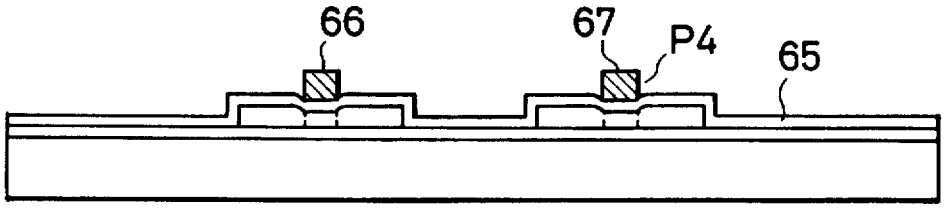

Further, a silicon film doped with phosphorus at a concentration $1–5\times10^{21}$ $cm^{-3}$, or a multi-layered film comprising this silicon film and molybdenum (Mo), tungsten (W), $MoSi_2$ or $WSi_2$ film formed thereupon, was formed on the above-mentioned silicon oxide film, which was then subjected to a patterning process using a fourth photomask P4, and the structure shown in FIG. 8(E) was obtained thereby. A gate electrode 66 for NTFT, as well as a gate electrode 67 for PTFT were formed: as a gate electrode a phosphorus-doped silicon layer was formed at a thickness of 0.2 micrometer, and a molybdenum layer was formed thereupon at a thickness of 0.3 micrometer, for example. The channel length was e.g. 7 μm.

In case of using aluminum (Al) as a gate electrode material, since a self-aligning process is available by anodic-oxidizing the surface of aluminum that is first patterned by a fourth photomask P4, the contact holes of source and drain can be formed closer to the gate, and TFT characteristic can be improved due to the increase in mobility as well as the reduction in threshold voltage.

Figure 8F:
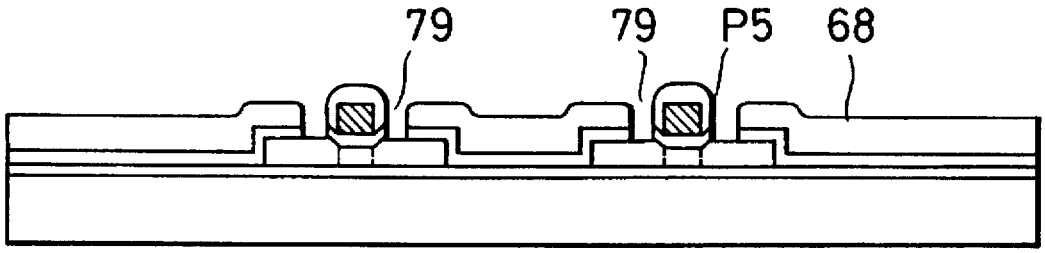
Figure 8G:
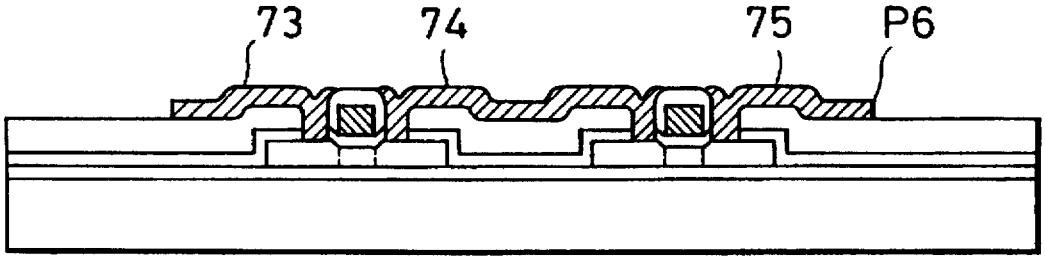
Figure 8H:
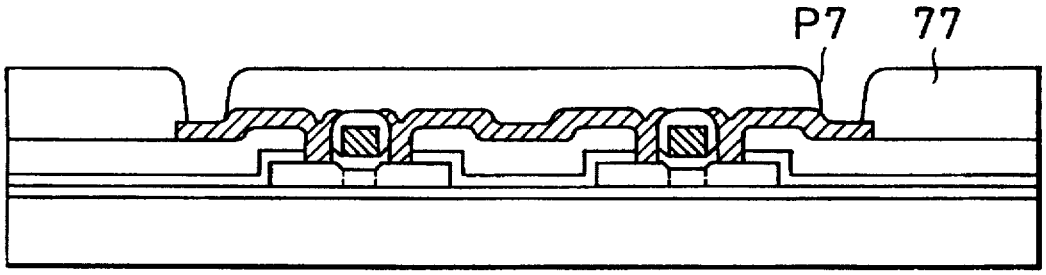
Figure 8I:
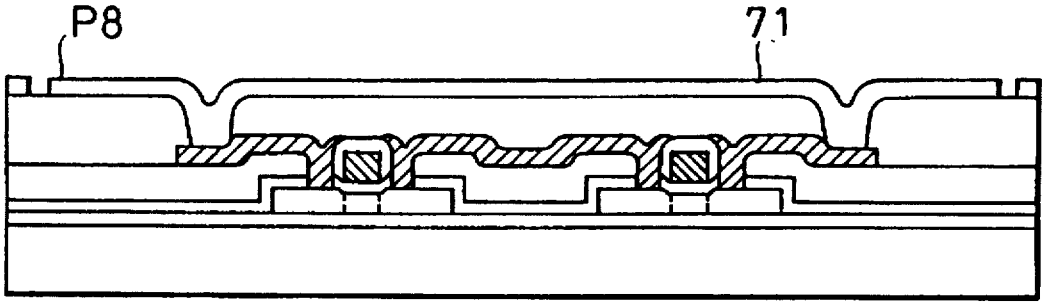
Figure 9A:
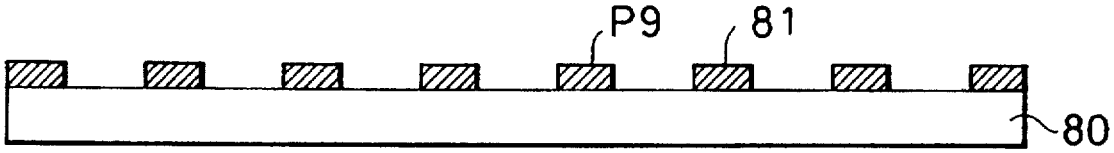
FIG. 9 shows a process of forming color filters in accordance with the preferred embodiment.
Figure 9B:
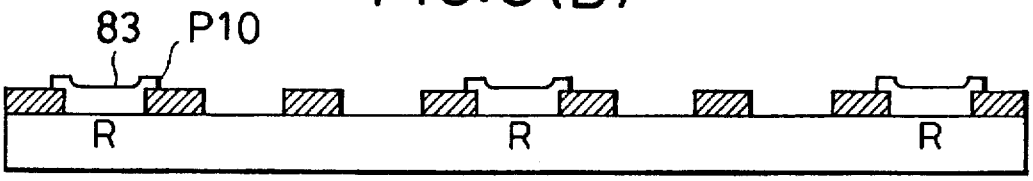
Figure 9C:
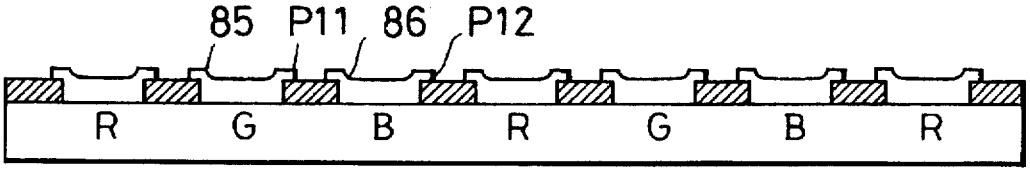
Figure 9D:
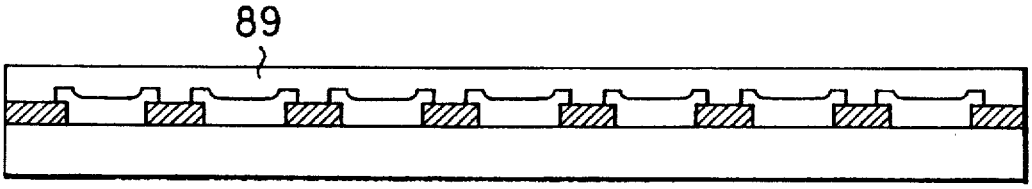
Figure 9E:
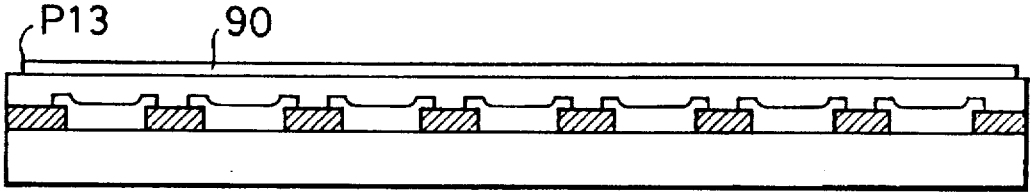

In this way, C/TFT can be manufactured without elevating the temperature not less than 400° C., in every process. Therefore, there is no need to use an expensive material such as quartz as a substrate, and it can be said that this is a most suitable process for manufacturing the wide-screen liquid crystal display device in accordance with the present invention. Referring to FIG. 8(F), an inter-layer insulating film 68 made of silicon oxide was formed by sputtering, in the manner described supra. The silicon oxide film can be formed by LPCVD, photo-CVD, or by atmospheric pressure CVD. The film was formed at a thickness of 0.2–0.6 micrometer, for example, and an opening 79 for electrode was formed using a fifth photomask P5. Aluminum was then sputtered over all of these at a thickness of 0.3 micrometer, and a lead 74 as well as contacts 73, 75 were formed using a sixth photomask P6, and thereafter an organic resin 77 for flattening or a transparent polyimide resin, for example, was applied to the surface thereof, and an opening was formed again in the organic resin 77 by a seventh photomask P7. An ITO (indium tin oxide) was sputtered over all of these, at a thickness of 0.1 micrometer, and a picture element electrode 71 was formed using an eighth photomask P8. The ITO was formed at a temperature ranging from room temperature to 150° C., and was then subjected to annealing process in oxygen or atmosphere at a temperature of 200°–400° C.

The electric characteristics of TFT thus obtained were: mobility was 40 ($cm^2$/Vs), and Vth −5.9(V) for PTFT, while mobility was 80 ($cm^2$/Vs), and Vth 5.0(V) for NTFT.

In this manner, one substrate for the electro-optical device was manufactured in accordance with the present invention.

The arrangement of the electrode, etc., of this liquid crystal display device is shown in FIG. 7. An N-channel thin film transistor and a P-channel thin film transistor are provided on the intersection of a first signal line 3 and a second signal line 4. The device has a matrix structure using such a C/TFT. NTFT is connected to a second signal line 4 through a contact of the input terminal of a drain 10, while a gate 9 is connected to the first signal line 3. The output terminal of a source 12 is connected to an electrode 17 of a picture element (pixel) through a contact.

On the other hand, the input terminal of a drain 20 is connected to the second signal line 4 through a contact, for PTFT, and a gate 21 of the PTFT is connected to the signal line 3, while the output terminal of a source 18 of the PTFT to the picture element electrode 17 through a contact, in the same way as for NTFT. The liquid crystal display device having picture elements as many as 640×480, 1280×960, or 1920×400 in this preferred embodiment, can be obtained by repeating such a structure horizontally and vertically. In this way, a first substrate was obtained.

The manufacturing method of the other substrate (a second substrate) is shown in FIG. 9. A polyimide resin for which a black pigment is mixed with polyimide was formed on a glass substrate at a thickness of 1 micrometer by a spin-coating method, and a black stripe 81 was manufactured by using a ninth photomask P9, whereafter, the polyimide resin mixed with a red pigment was formed at a thickness of 1 micrometer by the spin-coating method, and a red filter 83 was manufactured using a tenth photomask P10. A green filter 85 and a blue filter 86 were formed in the same manner, using masks P11 and P12. Each filter was baked in nitrogen at a temperature of 350° C., for sixty minutes, at the time of manufacturing thereof. A leveling layer 89 was then manufactured using transparent polyimide, again by spin-coating.

An ITO (indium tin oxide) was then sputtered over all of these at a thickness of 0.1 micrometer, and a common electrode 90 was formed using a thirteenth photomask P13. The ITO was formed at a temperature ranging from room temperature to 150° C., and was subjected to the annealing process in oxygen or atmosphere at a temperature of 200°–300° C., and a second substrate was thus obtained.

A polyimide precursor was then printed on the above-mentioned substrate using an offset method, and was baked in a non-oxidating atmosphere, e.g. in nitrogen, for an hour, at a temperature of 350° C. It was then subjected to a known rubbing method, and the quality of the polyimide surface was modified thereby, and whereby a means for orienting a liquid crystal molecule in a specific direction at least in an initial stage, was provided.

A nematic liquid crystal composition was sandwiched by the first and the second substrates formed in the way as described supra, and the periphery thereof was fixed with an epoxy bonding agent. A PCB having an electric potential wiring, a common signal and a TAB driver IC was connected to the lead on the substrate, while a polarizing plate was adhered to the outside, and a transmission-type liquid crystal electro-optical device was obtained thereby. A rear lightning device provided with three pieces of cold cathode tubes, and a tuner for receiving television radio wave, were connected to the liquid crystal electro-optical device, and the wall mounted television set was completed thereby. Since the device has a flatter shape than the conventional CRT television, it can be installed on the wall and the like. The operation of the liquid crystal television was verified by applying the signal which is substantially equal to the one shown in FIG. 1, to a liquid crystal picture element. The operation of the present liquid crystal television was also verified by applying the signal which is substantially equal to the one shown in FIG. 4, to the liquid crystal picture element.

PREFERRED EMBODIMENT 2

An electro-optical device having a diagonal of one inch was used in this second preferred embodiment to manufacture a view finder for video camera, which will be explained infra:

In this embodiment, the number of picture elements was 387×128, and the device was formed using a high mobility TFT obtained by the process at a low temperature, and the view finder was formed thereby. The arrangement of the active device on the substrate of the liquid crystal electro-optical device in accordance with this preferred embodiment, is shown in FIG. 7, and manufacturing process therefor will be explained with reference to FIG. 10 showing cross sections taken along A—A' and B—B' lines of FIG. 7.

Figures 10A, 10B, 10C, 10D, 10E, 10F, 10G:
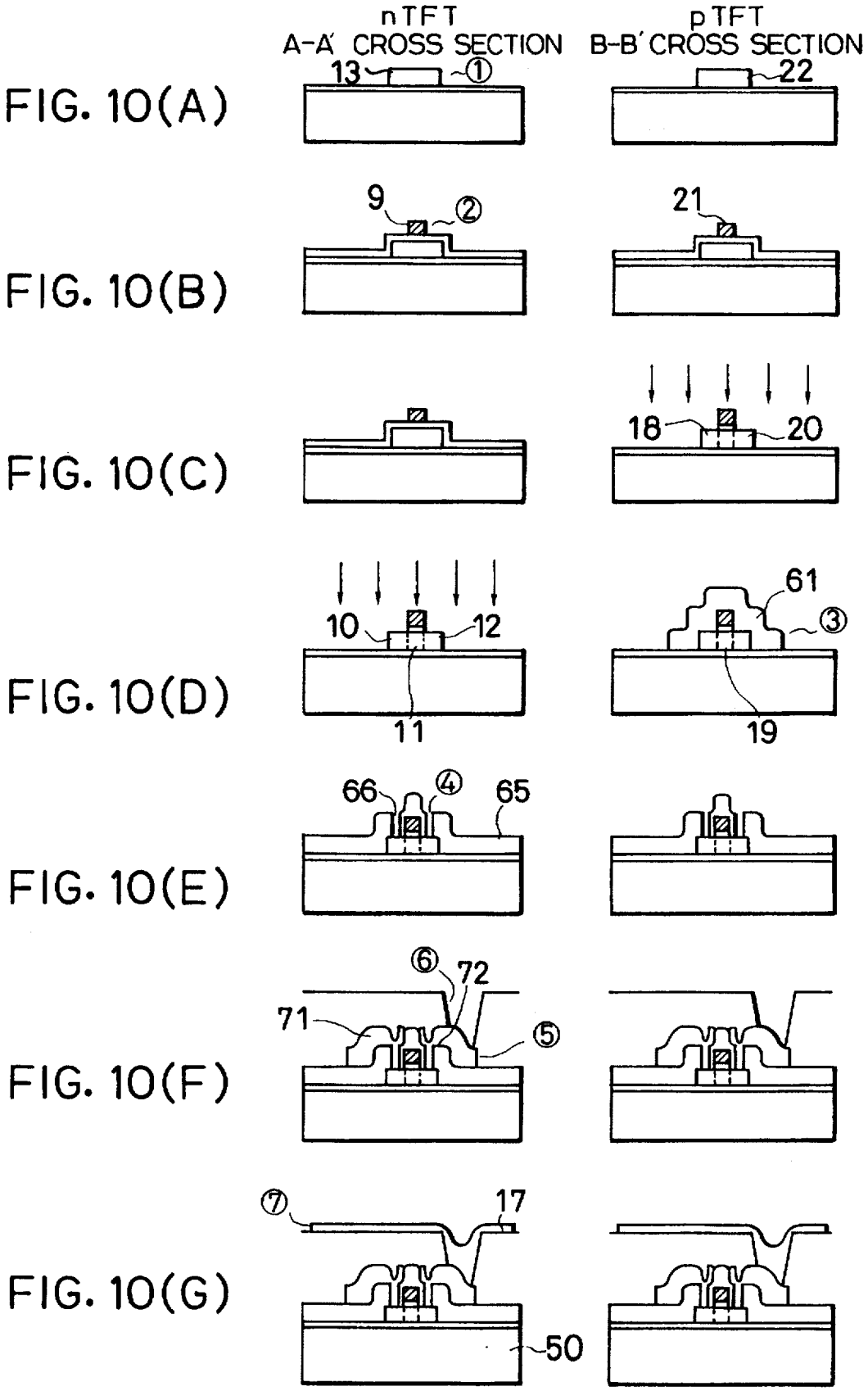
FIG. 10 shows a process of forming TFTs in accordance with the preferred embodiment.

Referring to FIG. 10(A), a silicon oxide film as a blocking layer 51 was manufactured at a thickness of 1000–3000 angstroms by magnetron RF (high frequency) sputtering, on the inexpensive glass substrate 50 that bears heat treatment of no more than 700° C., e.g. approximately 600° C. The conditions for the process were: in 100% oxygen atmosphere; temperature for film formation was 15° C.; output was 400–800 W; pressure was 0.5 Pa; and, rate of film formation was 30–100 angstroms/min. when quartz or single crystalline silicon was used as a target.

A silicon film was then formed thereon by LPCVD (low pressure chemical vapor deposition), sputtering, or by plasma CVD. In case of using the low pressure chemical vapor deposition, film formation was carried out by supplying, for example, disilane ($Si_2H_6$) or trisilane ($Si_3H_8$) to a CVD device, at a temperature of 450°–550° C., 100°–200° C. lower than the temperature for crystallization, e.g. at 530° C. The pressure in a reactor was 30–300 Pa, while the rate of film formation was 50–250 angstroms/min. Boron may be added to the film by means of diborane at a concentration of $1\times10^{15}$–$1\times10^{18}$ $cm^{-3}$, during the manufacture thereof, so as to control the threshold voltages (Vth) for PTFT and NTFT to almost equal value.

In case of using sputtering, film formation was carried out by defining the back pressure before sputtering as no more than $1\times10^{-5}$ Pa, and by using single crystalline silicon as a target, in the atmosphere in which 20–80% of hydrogen was mixed with argon; e.g. argon 20% and hydrogen 80%. The temperature for film formation was 150° C.; frequency was 13.56 MHz; sputtering output was 400–800 W; and, the pressure was 0.5 Pa.

In case of manufacturing silicon film by plasma CVD, the temperature was, for example, 300° C., and mono-silane ($SiH_4$) or disilane ($Si_2H_6$) was used. These were introduced into the PCVD device, and high frequency power of 13.56 MHz were applied thereto.

Oxygen in the film formed in this manner is preferably not more than $5\times10^{21}$ $cm^{-3}$. If the oxygen concentration is too high, crystallization will not be facilitated, and the temperature of thermal annealing must be elevated, or otherwise, the time for thermal annealing must be prolonged. If the oxygen concentration is too low, leakage current in an OFF condition is increased due to the illumination of back light. For this reason, the oxygen concentration range was determined as $4\times10^{19}$–$4\times10^{21}$ $cm^{-3}$. Hydrogen concentration was $4\times10^{20}$ $cm^{-3}$, or one atom % compared to the silicon at a concentration of $4\times10^{22}$ $cm^{-3}$.

After a silicon film in amorphous state was manufactured in this manner at a thickness of 500–5000 Å, e.g. at 1500 Å, it was subjected to middle temperature heat treatment in a non-oxidating atmosphere at a temperature of 450°–700° C., for 12–70 hours, or, for example, the film was maintained in a hydrogen atmosphere at a temperature of 600° C. Since the silicon oxide film of amorphous structure is formed on the substrate surface under the silicon film, a specific nucleus does not exist in the heat treatment, and the entire body is thus uniformly thermal-annealed. Namely, amorphous structure is retained during the manufacturing of the film, and hydrogen is simply mixed therein.

The silicon film was transformed from the amorphous structure into the state of higher order through the annealing, and a part thereof was observed as in a crystal state. A relatively higher order region of the silicon coated film, in particular, tends to be crystallized into a crystalline region by the annealing. However, silicon atoms are pulled with each other since bonds are formed between such regions by silicon atoms existing therebetween. According to the results of the measurement by Laser Raman Spectroscopy, a peak is observed as shifted to the lower frequency compared with a single crystal silicon peak, i.e. 522 $cm^{-1}$. The apparent grain diameter thereof is calculated 50–500 angstroms (50–500 angstroms correspond to grain diameter of microcrystal), based on a half band width, however, actually, semi-amorphous structure in which a number of high crystallinity regions constituting cluster structure are formed to anchor clusters to each other by bond between silicons in the film is obtained.

As a result, it can be said that substantially no GB exists in the film. Since carriers easily move between each cluster through the anchored points, carrier mobility higher than that of polycrystalline silicon in which GB obviously exists, is obtained. Namely, Hall mobility (μh) is 10–200 $cm^2$/VSec; and, electron mobility (μe) is 15–300 $cm^2$/VSec.

If the silicon coated film is polycrystallized through high temperature annealing of 900°–1200° C., instead of the middle temperature annealing process as mentioned above, impurities in the film are segregated due to a solid growth from nucleus, and impurities such as oxygen, carbon, nitrogen are thereby increased in GB. These impurities will form a barrier in GB, and the movement of the carriers is hindered thereby, though the mobility is higher in crystal. Consequently, it is extremely difficult to achieve the mobility of no less than 10 $cm^2$/Vsec in practice. For this reason, the silicon semiconductor that has semi-amorphous or semi-crystalline structure is used in this embodiment.

Referring to FIG. 10(A), the silicon coated film was photo-etched by a first photomask 1, and a region 13 (channel width of 20 micrometer) for NTFT was manufactured on the side of the A—A' cross section shown in the figure, and a region 22 for PTFT on the side of the B—B' cross section.

A silicon oxide film was formed thereupon as a gate insulating film at a thickness of 500–2000 angstroms, e.g. at 1000 angstroms. The manufacturing condition was the same for the silicon oxide film as a blocking layer. A small amount of fluorine may be added to the film during the manufacturing thereof, so as to stabilize sodium ion.

A silicon film doped with phosphorus at a concentration $1$–$5\times10^{21}$ $cm^{-3}$, or a multi-layered film comprising this silicon film and molybdenum (Mo), tungsten (W), $MoSi_2$ or $WSi_2$ film formed thereupon, was formed, which was then subjected to a patterning process using a second photomask ②, and the structure shown in FIG. 10(B) was thus obtained. A gate electrode 9 for NTFT, as well as a gate electrode 21 for PTFT were then formed. In this preferred embodiment: the channel length for NTFT was 10 micrometer; the channel length for PTFT was 7 micrometer. As a gate electrode, a P-doped Si layer was formed at a thickness of 0.2 micrometer and a molybdenum layer was formed thereupon by 0.3 micrometer.

Referring to FIG. 10(C), boron was ion-implanted at a dose of $1–5\times10^{15}$ $cm^{-2}$ to a source 18 and a drain 20 for PTFT. Referring to FIG. 10(D), a photoresist 61 was then formed using a photomask ③. Phosphorus was ion-implanted at a dose of $1–5\times10^{15}$ $cm^{-2}$, to a source 10 and a drain 12 for NTFT.

In case of using aluminum (Al) as a gate electrode material, since a self-aligning process is possible by anodic-oxidizing the surface of the aluminum which is primarily patterned by a second photomask ②, the contact holes of source and drain can be formed closer to the gate, and TFT characteristic can be further improved due to the increase in mobility as well as the reduction in threshold voltage.

Thermal annealing process was carried out again at a temperature of 600° C., for 10–50 hours. A source 10 and a drain 12 for NTFT as well as a source 18 and a drain 20 for PTFT were manufactured as $N^+$ type and $P^+$ type, respectively, by activating impurities. Channel forming regions 19 and 11 are formed as semi-amorphous semiconductors, under gate electrodes 21 and 9.

In this way, C/TFT can be manufactured without elevating the temperature not less than 700° C., in every process, though a self-aligning method is employed. Therefore, it is not necessary to use an expensive material such as quartz for the substrate, and it can be said that this is a most suitable process for manufacturing the wide-screen liquid crystal display device in accordance with the present invention. Thermal annealing was carried out twice in this embodiment, as shown in FIGS. 10(A) and (D). The annealing process described in FIG. 10(A) may be omitted according to a desirable characteristic, and the time for manufacturing can be shortened by carrying out only the annealing process described in FIG. 10(D), instead of carrying out the two annealing processes. Referring to FIG. 10(E), a silicon oxide film was formed as an inter-layer insulating material 65 by sputtering in the manner as described supra. The silicon oxide film can be formed by LPCVD, photo-CVD, or by atmospheric pressure CVD, at a thickness of, for example, 0.2–0.6 micrometer, and an opening 66 for electrode was formed thereafter using a photomask ④. Aluminum was then sputtered over the entire surface as shown in FIG. 10(F), and after a lead 71 as well as a contact 72 were manufactured using a photomask ⑤, an organic resin 69 for flattening, or a transparent polyimide resin, for example, was applied to the surface, and an opening for electrode was formed again with a photomask ⑥.

An ITO (indium tin oxide) was formed by sputtering to connect a picture element transparent electrode (ITO) of the liquid crystal device with output terminals of the two TFTs in complementary structure. The ITO was then etched by a photomask ⑦, and an electrode 17 was thus formed. The ITO was formed at a temperature ranging from room temperature to 150° C., and was then subjected to annealing process in atmosphere or in an oxygen at 200°–400° C. NTFT 13, PTFT 22, and an electrode 17 of transparent conductive film were thus manufactured on the same glass substrate 50. The electric characteristics of the TFTs thus obtained were: mobility of 20 ($cm^2$/Vs), Vth of −5.9(V) for PTFT; and, mobility of 40 ($cm^2$/Vs), and Vth of 5.0(V) for NTFT.

In this manner, a first substrate for the liquid crystal device was manufactured. The arrangement of the electrode, etc., of the liquid crystal device is shown in FIG. 7. Thus the device has a matrix form using such a C/TFT.

An ITO (indium tin oxide) was then sputtered on a silicon oxide film 2000 angstroms thick, that was sputtered on a soda-lime glass substrate, so as to obtain a second substrate. The ITO was formed at a temperature ranging from room temperature to 150° C., and was then subjected to annealing process in atmosphere or in oxygen at a temperature of 200°–400° C. A color filter layer was then formed on the substrate in the same manner as described in the Preferred Embodiment 1, and thus the second substrate was formed.

A polyimide precursor was then printed on the above-mentioned substrate by an offset method, which was baked in a non-oxidating atmosphere, e.g. in nitrogen, for an hour, at a temperature of 350° C. The polyimide surface was then modified by a known rubbing method, and a means to align liquid crystal molecules in a certain direction at least in an initial stage, was provided, and the first and the second substrates were thus provided.

The nematic liquid crystal composition was sandwiched by the abovementioned first and second substrates, and the periphery thereof was fixed with an epoxy bonding agent. Bonds were carried out by COG method, since the pitch of the lead on the substrate was as small as 46 micrometer. In this embodiment, a gold bump provided on an IC chip was bonded by epoxy silver palladium resin, and an epoxy modified acrylic resin for solidification and sealing was buried between the IC chip and the substrate, so as to stabilize them. A polarizing plate was then adhered to the outside thereof, and a transmission type liquid crystal device was thus obtained.

The drive waveform used in this embodiment is shown in FIG. 2. A ramp waveform was used in this embodiment instead of the sine wave used in the preferred embodiment 1. The operation of the device was verified by using the waveform as shown in FIG. 3, which was a slight modification of the one shown in FIG. 2.

This embodiment is characterized by the execution of digital gradation display, compared with a completely analog gradation display which has been adopted conventionally. In case of employing a liquid crystal electro-optical device having picture elements of 640×400 dots, it is very difficult to manufacture TFTs of total amount of 256,000 without generating difference in every characteristic. In practice, a 16-gradation display is supposed to be an upper limit in case of the conventional analog gradation display when mass productivity and yield are taken into consideration. However, clear digital gradation display is achieved according to the present invention which is characterized by covering the difference in TFT characteristics through the control of the voltage to be applied to TFT, by inputting not an analog value, but a reference signal, from the controller side, and controlling the timing of connecting the reference signal to TFT in terms of digital value, in order to make a voltage level to be applied clear.

PREFERRED EMBODIMENT 3

In this embodiment, a wall mounted television set manufactured by using a liquid crystal display device having a circuit structure as shown in FIG. 5, will be explained. Polycrystalline silicon subjected to laser annealing was used for TFT.

Figure 11A:
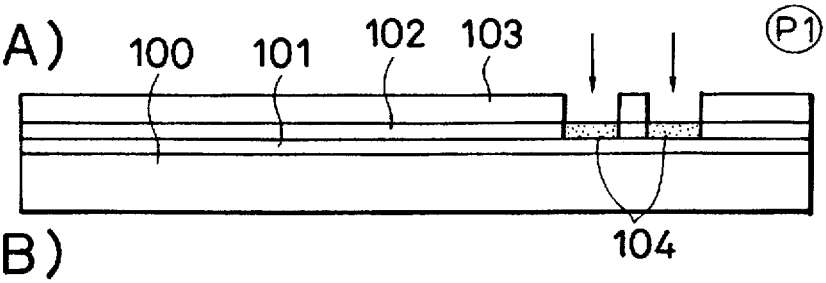
FIG. 11 shows a process of forming TFTs in accordance with the preferred embodiment.
Figure 11B:
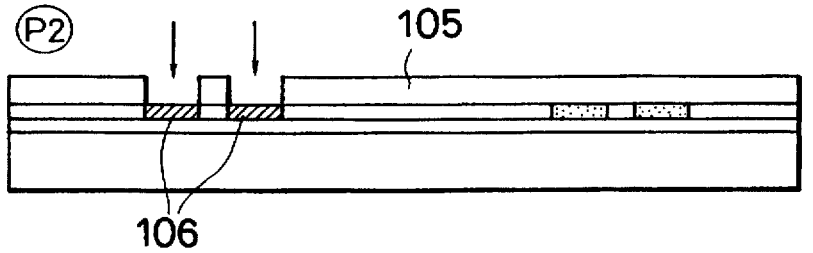
Figure 11C:
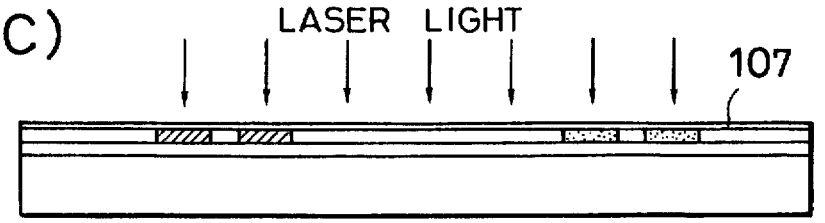
Figure 11D:
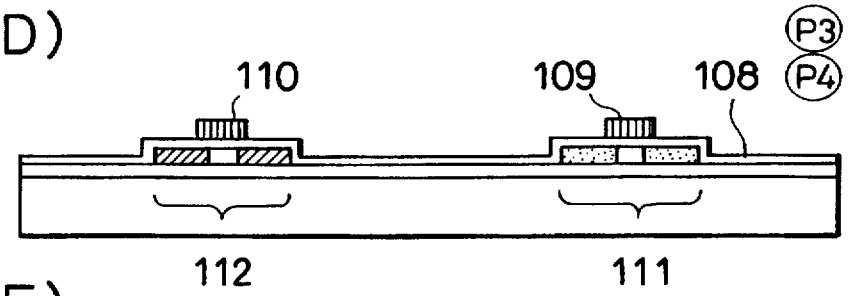

The manufacturing of a TFT part will be described infra according to FIG. 11. Referring to FIG. 11(A), a silicon oxide film was manufactured as a blocking layer 101 on an inexpensive glass substrate 100 which bears the heat treatment of not more than 700° C., e.g. approximately 600° C., at a thickness of 1000–3000 angstroms by magnetron RF (high frequency) sputtering. The conditions for the process were: in 100% oxygen atmosphere; the temperature for film formation was 15° C.; output was 400–800 W; and, pressure was 0.5 Pa. The rate of film formation was 30–100 angstroms/min, when quartz or single crystalline silicon was used as a target.

A silicon film 102 was manufactured thereon by plasma CVD. The temperature for film formation was 250° C.–350° C., e.g. 320° C. In this embodiment, mono-silane ($SiH_4$) was used, however, disilane ($Si_2H_6$) or trisilane ($Si_3H_8$) can be used instead. These were introduced into a PCVD device at a pressure 3 Pa, and the film formation was carried out by applying high frequency power of 13.56 MHz thereto. The high frequency power should be 0.02–0.10 W/cm$^2$, or 0.055 W/cm$^2$ in this embodiment. The flow rate of mono-silane ($SiH_4$) was 20 SCCM, and the rate of film formation was approximately 120 angstroms/min. Boron may be added to the film by means of diborane during the film formation at a concentration of $1\times10^{15}$–$1\times10^{18}$ cm$^{-3}$, so as to set the threshold voltages (Vth) for PTFT and for NTFT to almost equal level. When a silicon layer that will be a channel region of TFT is to be formed, sputtering or low pressure CVD can be employed instead of plasma CVD, which will be briefly described infra.

In case of sputtering, the back pressure before sputtering should be not more than $1\times10^{-5}$ Pa, and the sputtering was carried out in the atmosphere for which 20–80% of hydrogen was mixed with argon; e.g. 20% of argon and 80% of hydrogen. The target was single crystal silicon. The temperature for film formation was 150° C.; frequency was 13.56 MHz; sputtering output was 400–800 W; and, pressure was 0.5 Pa.

In case of carrying out low pressure CVD, film formation was carried out by supplying disilane ($Si_2H_6$) or trisilane ($Si_3H_8$) to a CVD device at a temperature of 450°–550° C., 100°–200° C. lower than the temperature for crystallization, e.g. at 530° C. The pressure in a reactor was 30–300 Pa. The rate of film formation was 50–250 angstroms/min. Boron may be added to the film by means of diborane during the film formation at a concentration of $1\times10^{15}$–$1\times10^{18}$ cm$^{-3}$, so as to set the threshold voltages (Vth) for PTFT and for NTFT to almost equal level.

Oxygen in the film thus formed should be not more than $5\times10^{21}$ cm$^{-3}$. Oxygen concentration should be not more than $7\times10^{19}$ cm$^{-3}$, or preferably not more than $1\times10^{19}$ cm$^{-3}$, so as to promote crystallization, however, if it is too low, the leakage current in OFF state will be increased due to the illumination of a back light, thus the abovementioned level is supposed to be optimum. If oxygen concentration is too high, crystallization will not be facilitated, and the temperature for laser annealing must be higher or the time for laser annealing longer. Hydrogen concentration was $4\times10^{20}$ cm$^{-3}$, or one atom % compared with the silicon at a concentration of $4\times10^{22}$ cm$^{-3}$.

Oxygen concentration should be not more than $7\times10^{19}$ cm$^{-3}$, preferably not more than $1\times10^{19}$ cm$^{-3}$, in order to promote crystallization for source and drain, and oxygen can be ion-implanted only into channel forming regions of TFTs constituting pixels, at a concentration of $5\times10^{20}$–$5\times10^{21}$ cm$^{-3}$. The silicon film in amorphous state was thus formed by 500–5000 angstroms, or by 1000 angstroms in this embodiment.

A photoresist pattern 103 having openings therein only over regions to be source and drain regions of NTFT was then formed by using a mask P1. Phosphorus ion was ion-implanted at concentrations $2\times10^{14}$–$5\times10^{16}$ cm$^{-2}$, preferably at $2\times10^{16}$ cm$^{-2}$ by using the resist 103 as a mask, and n-type impurity regions 104 were formed thereby, and the resist 103 was removed thereafter.

In the same way, a resist 105 was applied and a pattern thereof having openings therein only over regions to be source and drain regions of PTFT was formed by the use of a mask P2. p-type impurity regions were formed by using the resist 105 as a mask. Boron was ion-implanted as an impurity at a concentration of $2\times10^{14}$–$5\times10^{16}$ cm$^{-2}$, or preferably by $2\times10^{16}$ cm$^{-2}$. The structure shown in FIG. 11(B) was thus obtained.

A silicon oxide film 107 of 50–300 nm, e.g. 100 nm was then formed on the silicon film 102, by the abovementioned RF sputtering. Source, drain and channel regions were crystallized and activated through laser annealing using a XeCl excimer laser. The threshold level of the laser energy was 130 mJ/cm$^2$, and it should be 220 mJ/cm$^2$ so as to melt the entire film. If the energy of no less than 220 mJ/cm$^2$ is irradiated from the start, the film will be damaged, since the hydrogen existing in the film is abruptly ejected. For this reason, the film must be melted only after the hydrogen is purged out first at a low energy. In this embodiment, after hydrogen was purged out at an energy of 150 mJ/cm$^2$, crystallization was carried out at 230 mJ/cm$^2$. After the laser annealing was completed, the silicon oxide film 107 was removed.

Island-like NTFT region 111 and PTFT region 112 were then formed by a photomask P3. A silicon oxide film 108 was formed thereupon as a gate insulating film at a thickness of 500–2000 angstroms, e.g. 1000 angstroms. The manufacturing conditions were the same as for those of the silicon oxide film as a blocking layer. A little amount of fluorine may be added to the film during the manufacturing thereof, so as to stabilize sodium ion.

A silicon film containing therein phosphorus at a concentration of $1$–$5\times10^{21}$ cm$^{-3}$ or a multi-layered film comprising this silicon film and a molybdenum (Mo), tungsten (W), $MoSi_2$ or $WSi_2$ film formed thereon, was formed thereupon. This was patterned by a fourth photomask P4, and the structure shown in FIG. 11(D) was thus obtained. A gate electrode 109 for NTFT and a gate electrode 110 for PTFT were formed. For example, the channel length was 7 micrometer and as a gate electrode phosphorus-doped silicon layer was formed at a thickness of 0.2 micrometer and molybdenum layer was formed thereon at a thickness of 0.3 micrometer.

In case of using aluminum (Al) as a gate electrode material, since a self-aligning process is available by anodic-oxidating the surface of the aluminum which is primarily patterned by a fourth photomask P4, the contact holes of source and drain can be formed closer to the gate, and TFT characteristic is further improved due to the increase in mobility and the reduction in threshold voltage.

In this way, C/TFT can be manufactured without elevating the temperature no less than 400° C., in every process. Therefore, there is no need to use an expensive substrate such as a quartz, and it can be said that this is a most suitable process for the wide-screen liquid crystal display device in accordance with the present invention.

Figure 11E:
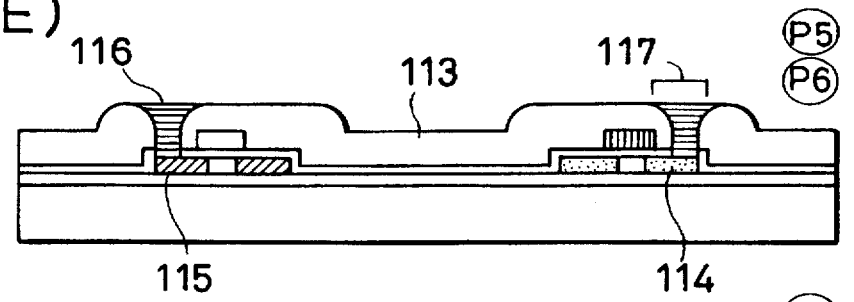
Figure 11F:
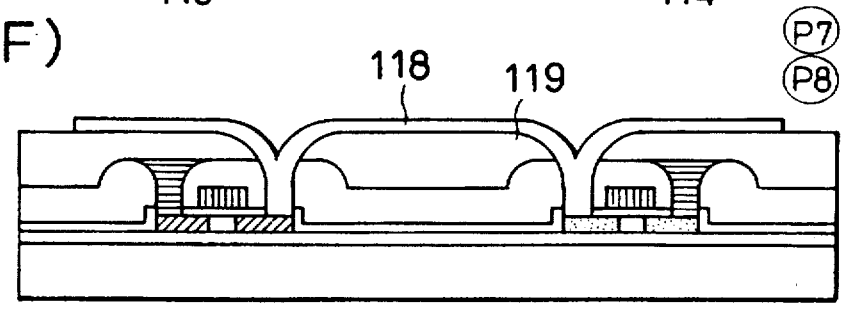

Referring to FIG. 11(E), a silicon oxide film was formed as an inter-layer insulator 113 by sputtering in the way described supra. The silicon oxide film can be formed by LPCVD, photo-CVD, or by atmospheric pressure CVD, at a thickness of 0.2–0.6 micrometer, for example, and an opening 117 for electrode was then formed by using a fifth photomask P5. Aluminum was further sputtered over the entire surface of these at a thickness of 0.3 micrometer, and, after a lead 116 and contacts 114 and 115 were manufactured by using a sixth photomask P6, an organic resin 119 for flattening, e.g. a transparent polyimide resin was applied to the surface thereof, and openings for electrodes were formed therein by using a seventh photomask P7. An ITO (indium tin oxide) was sputtered on the entire surface of these at a thickness of 0.1 micrometer, and a picture element electrode 118 was formed by using an eighth photomask P8. The ITO was formed at a temperature ranging from room temperature to 150° C., and was then subjected to annealing process in atmosphere or in oxygen at a temperature of 200°–400° C.

The electric characteristic of the TFTs thus obtained was: mobility of 35 ($cm^2/Vs$), Vth of −5.9(V) for PTFT, and mobility of 90 ($cm^2/Vs$), and Vth of 4.8(V) for NTFT.

In this way, a first substrate for the liquid crystal electro-optical device was obtained. The manufacture of the other substrate (a second substrate), which is the same as described in the preferred embodiment 1, is omitted here. A nematic liquid crystal composition was then sandwiched by the abovementioned first and second substrates, and the periphery thereof was fixed by an epoxy bonding agent. PCB having an electric potential wiring, a common signal, and a TAB-shaped driver IC were connected to the lead on the substrate, and a polarizing plate was adhered to the outside, and a transmission type liquid crystal electro-optical device was thus obtained. A wall mounted television set was completed by connecting this device with a tuner for receiving television electric wave and a rear lighting device comprising three pieces of cold cathode-ray tubes. Since the device becomes flatter compared with a conventional CRT type television, it can be installed on the wall and the like. The operation of this display device was verified by applying the signal substantially the same as the one shown in FIG. 4, to a liquid crystal picture element.

The foregoing description of preferred embodiments has been presented for purposes of illustration and description. It is not intended to be exhaustive or to limit the invention to the precise form described, and obviously many modifications and variations are possible in light of the above teaching. The embodiments were chosen in order to explain most clearly the principles of the invention and its practical application thereby to enable others in the art to utilize most effectively the invention in various embodiments and with various modifications as are suited to the particular use contemplated. An example of such modifications is as follows.

Figure 12:
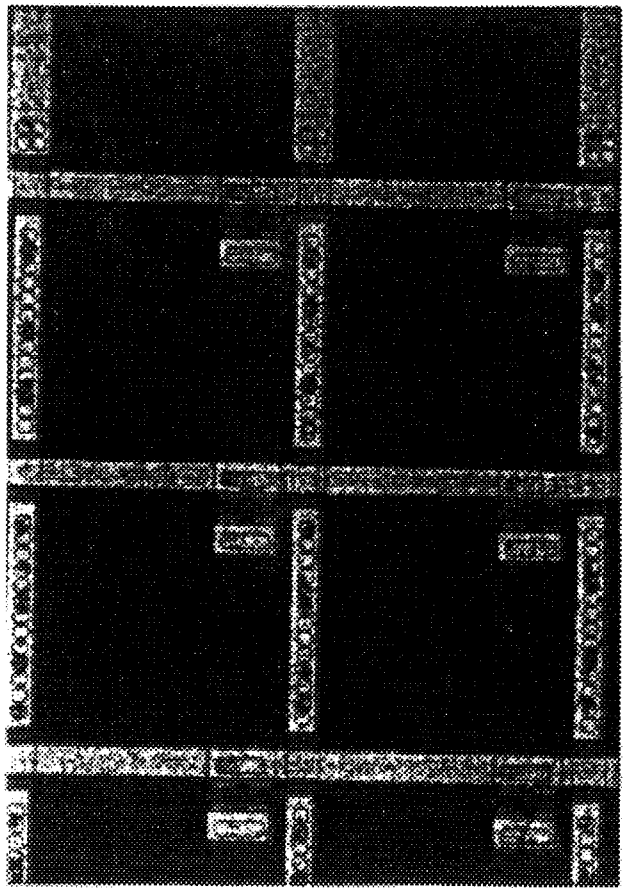
FIG. 12 is a copy of a photograph showing an electric circuit in accordance with the present invention.

FIG. 12 is a copy of a photograph showing an electric circuit which was actually manufactured in accordance with the present invention. Circuit diagram of this electric circuit is the same as that shown in FIG. 5. The electric circuit shown in FIG. 12 is a modification of the electric circuit shown in FIG. 7. The difference between them lies in shape of gate electrodes thereof, for example.

What is claimed is:

1. A method of driving an electro-optical device comprising:

a substrate;

an electro-optical modulating layer provided on said substrate;

a plurality of pixel electrodes $Z_{11}$ to $Z_{NM}$ (N and M are integer; N>1; and M>1) provided on said substrate;

a plurality of first signal lines $X_1$ to $X_N$ provided on said substrate; and a plurality of second signal lines $Y_1$ to $Y_M$ provided on said substrate; and a plurality of complementary transistor pairs provided on said substrate, each pair comprising a p-channel and an n-channel transistor and connected to (a) a pixel electrode $Z_{nm}$ (n and m are integer; $1 \leqq n \leqq N$; and $1<m<M$) at one of source and drain terminals of said n-channel transistor and at one of source and drain terminals of said p-channel transistor, (b) first signal line $X_n$ associated with pixel electrode $Z_{nm}$ at gate terminals of said p-channel transistor and said n-channel transistor, and (c) second signal line $Y_m$ associated with pixel electrode $Z_{nm}$ at the other one of the source and drain terminals of said p-channel transistor and at the other one of the source and drain terminals of said n-channel transistor, said method comprising the steps of:

applying a reference signal to the second signal line $Y_m$ with no signal applied to the second signal lines other than the second signal line $Y_m$ during duration of said reference signal;

applying a bipolar signal comprising two pulses having opposite polarities to each of the first signal lines $X_1$ to $X_N$ during duration of said reference signal;

applying a bipolar signal comprising two pulses having opposite polarities to all of the first signal lines $X_1$ to $X_N$ at the same time during an interval between each application of said reference signal to said second signal lines.

2. The method of claim 1 wherein said electro-optical modulating layer comprises a liquid crystal selected from the group consisting of a nematic liquid crystal, a polymer liquid crystal, a ferroelectric liquid crystal and an antiferroelectric liquid crystal.

3. The method of claim 1 wherein said reference signal comprises a wave selected from the group consisting of a sine wave, a cosine wave, a chopping wave and a ramp wave.

4. The method of claim 1 wherein said reference signal comprises a rectangular pulse.

5. A method of driving an electro-optical device comprising:

a substrate;

an electro-optical modulating layer provided on said substrate;

a plurality of pixel electrodes $Z_{11}$ to $Z_{NM}$ (N and M are integer; $N \geqq 1$; and $M \geqq 1$) provided on said substrate;

a plurality of first signal lines $X_1$ to $X_N$ provided on said substrate;

a plurality of second signal lines $Y_1$ to $Y_M$ provided on said substrate; and a plurality of complementary transistor pairs provided on said substrate, each pair comprising a p-channel and an n-channel transistor and connected to (a) a pixel electrode $Z_{nm}$ (n and m are integer; $1 \leqq n \leqq N$; and $1 \leqq m \leqq M$) at one of source and drain terminals of said n-channel transistor and at one of source and drain terminals of said p-channel transistor, (b) first signal line $X_n$ associated with pixel electrode $Z_{nm}$ at gate terminals of said p-channel transistor and said n-channel transistor, and (c) second signal line $Y_m$ associated with pixel electrode $Z_{nm}$ at the other one of the source and drain terminals of said p-channel transistor and at the other one of the source and drain terminals of said n-channel transistor, said method comprising the steps of:

applying a reference signal only to the second signal line $Y_m$;

applying a bipolar signal comprising two pulses having opposite polarities to each of the first signal lines $X_1$ to $X_N$ during duration of said reference signal; and applying a bipolar signal comprising two pulses having opposite polarities to all of the first signal lines $X_1$ to $X_N$ at the same time during an interval between each application of said reference signal to said second signal lines.

6. The method of claim 5 wherein said reference signal comprises a wave selected from the group consisting of a sine wave, a cosine wave, a chopping wave and a ramp wave.

7. The method of claim 5 wherein said electro-optical device further comprises another substrate provided on said electro-optical modulating layer with another electrode provided therebetween.

8. The method of claim 5 wherein said reference signal comprises a rectangular pulse.

9. The method of claim 5 wherein no signal is applied to the second signal lines other than the second signal line $Y_m$ during duration of said reference signal.

10. A method of driving an electro-optical device comprising:

a substrate;

an electro-optical modulating layer provided on said substrate;

a plurality of pixel electrodes $Z_{11}$ to $Z_{NM}$ (N and M are integer; $N \geqq 1$; and $M \geqq 1$) provided on said substrate;

a plurality of first signal lines $X_1$ to $X_N$ provided on said substrate;

a plurality of second signal lines $Y_1$ to $Y_M$ provided on said substrate;

a plurality of complementary transistor pairs provided on said substrate, each pair comprising a p-channel and an n-channel transistor and connected to (a) a pixel electrode $Z_{nm}$ (n and m are integer; $1 \leqq n \leqq N$; and $1 \leqq m \leqq M$) at one of source and drain terminals of said n-channel transistor and at one of source and drain terminals of said p-channel transistor, (b) first signal line $X_n$ associated with pixel electrode $Z_{nm}$ at gate terminals of said p-channel transistor and said n-channel transistor, and (c) second signal line $Y_m$ associated with pixel electrode $Z_{nm}$ at the other one of the source and drain terminals of said p-channel transistor and at the other one of the source and drain terminals of said n-channel transistor;

said method comprising the steps of:

applying a reference signal to the second signal line $Y_m$ where the signal level of the reference signal varies during the application of said reference signal to the second signal line $Y_m$ with no signal applied to the second signal lines other than the second signal line $Y_m$ during the duration of said reference signal; and selectively applying a bipolar signal comprising two pulses having opposite polarities to the first signal lines $X_1$ to $X_N$ during the duration of said reference signal at a respective timing where said timing determines the magnitude of a voltage applied to the pixel electrodes at the intersection between the second signal line being supplied with the reference signal and the selected first signal lines being applied with said bipolar signal.

11. The method of claim 10 wherein said electro-optical modulating layer comprises a liquid crystal selected from the group consisting of a nematic liquid crystal, a polymer liquid crystal, a ferroelectric liquid crystal and an antiferroelectric liquid crystal.

12. The method of claim 10 wherein said reference signal comprises a wave selected from the group consisting of a sine wave, a cosine wave, a chopping wave and a ramp wave.

13. The method of claim 10 wherein said electro-optical device further comprises another substrate provided on said electro-optical modulating layer with another electrode provided therebetween.

14. A method of driving an electro-optical device comprising:

a substrate;

an electro-optical modulating layer provided on said substrate;

a plurality of pixel electrodes $Z_{11}$ to $Z_{NM}$ (N and M are integer; $N \geqq 1$; and $M \geqq 1$) provided on said substrate;

a plurality of first signal lines $X_1$ to $X_N$ provided on said substrate;

a plurality of second signal lines $Y_1$ to $Y_M$ provided on said substrate; and a plurality of complementary transistor pairs provided on said substrate, each pair comprising a p-channel and an n-channel transistor and connected to (a) a pixel electrode $Z_{nm}$ (n and m are integer; $1 \leqq n \leqq N$; and $1 \leqq m \leqq M$) at one of source and drain terminals of said n-channel transistor and at one of source and drain terminals of said p-channel transistor, (b) first signal line $X_n$ associated with pixel electrode $Z_{nm}$ at gate terminals of said p-channel transistor and said n-channel transistor, and (c) second signal line $Y_m$ associated with pixel electrode $Z_{nm}$ at the other one of the source and drain terminals of said p-channel transistor and at the other one of the source and drain terminals of said n-channel transistor;

said method comprising the steps of:

applying a reference signal to the second signal line $Y_m$ where the signal level of the reference signal varies during the application of said reference signal only to the second signal line $Y_m$; and selectively applying a bipolar signal comprising two pulses having opposite polarities to the first signal lines $X_1$ to $X_N$ during the duration of said reference signal at a respective timing where said timing determines the magnitude of a voltage applied to the pixel electrodes at the intersection between the second signal line being supplied with the reference signal and the selected first signal lines being applied with said bipolar signal.

15. The method of claim 14 wherein said electro-optical modulating layer comprises a liquid crystal selected from the group consisting of a nematic liquid crystal, a polymer liquid crystal, a ferroelectric liquid crystal and an antiferroelectric liquid crystal.

16. The method of claim 14 wherein said reference signal comprises a wave selected from the group consisting of a sine wave, a cosine wave, a chopping wave and a ramp wave.

17. The method of claim 14 wherein said electro-optical device further comprises another substrate provided on said electro-optical modulating layer with another electrode provided therebetween.

18. The method of claim 14 wherein no signal is applied to the second signal lines other than the second signal line $Y_m$ during duration of said reference signal.

19. A method of driving an electro-optical device comprising the steps of:

applying a reference signal to one of address signal lines with no signal applied to the address signal lines other than said one of address signal lines during duration of said reference signal;

applying a bipolar signal comprising two pulses having opposite polarities to each of data signal lines during duration of said reference signal; and applying a bipolar signal comprising two pulses having opposite polarities to all of the data signal lines at the same time during an interval between each application of said reference signal to said address lines.

20. A method of driving an electro-optical device comprising the steps of:

applying a reference signal to only one of address signal lines;

applying a bipolar signal comprising two pulses having opposite polarities to each of data signal lines during duration of said reference signal; and applying a bipolar signal comprising two pulses having opposite polarities to all of the data signal lines at the same time during an interval between each application of said reference signal to said address lines.

21. An electro-optical device comprising:

a substrate;

an electro-optical modulating layer provided on said substrate;

means for applying a reference signal to one of address signal lines where the signal level varies during the application of said reference signal to said one of the address signal lines with no signal applied to the address signal lines other than said one of the address signal lines during the duration of said reference signal; and means for selectively applying a bipolar signal comprising two pulses having opposite polarities to each of data signal lines during duration of said reference signal at a respective timing where said timing determines the magnitude of a voltage applied to the pixel electrodes at the intersection between the address signal line being supplied with the reference signal and the selected data signal lines being applied with said bipolar signal.

22. The device of claim 21 wherein said electro-optical modulating layer comprises a liquid crystal selected from the group consisting of a nematic liquid crystal, a polymer liquid crystal, a ferroelectric liquid crystal and an antiferroelectric liquid crystal.

23. An electro-optical device comprising:

a substrate;

an electro-optical modulating layer provided on said substrate;

means for applying a reference signal to one of address signal lines where the signal level varies during the application of said reference signal to only one of said address signal lines; and means for selectively applying a bipolar signal comprising two pulses having opposite polarities to each of data signal lines during duration of said reference signal at a respective timing where said timing determines the magnitude of a voltage applied to the pixel electrodes at the intersection between the address signal line being supplied with the reference signal and the selected data signal lines being applied with said bipolar signal.

24. The device of claim 23 wherein said electro-optical modulating layer comprises a liquid crystal selected from the group consisting of a nematic liquid crystal, a polymer liquid crystal, a ferroelectric liquid crystal and an antiferroelectric liquid crystal.

25. A method of driving an active matrix electro-optical device comprising a plurality of pixel electrodes in a matrix form, switching elements respectively provided for said pixel electrodes, and a plurality of address lines and signal lines connected to said switching elements, said method comprising:

scanning the address lines in sequence with a reference voltage;

applying select signals selectively to the signal lines at a respective timing during the application of the reference voltage to one of the address lines so that the pixel electrodes at intersections between said one of the address lines and the selected signal lines are supplied with the reference voltage; and removing the reference voltage supplied to said pixel electrodes during an interval between each scanning period of the address lines with the reference voltage.

26. The method of claim 25 wherein the duration in which the reference voltage is applied to said pixel electrodes is respectively controlled by controlling the timing of the application of the select signals to the selected signal lines, respectively.

27. The method of claim 25 wherein each of said switching elements is a transfer gate device.

28. The method of claim 25 wherein each of said switching elements comprises a p-channel transistor and a n-channel transistor where one of source and drain of said p-channel transistor and one of source and drain of said n-channel transistor are connected to one of the address lines, the other ones of the source and drain of said p-channel transistor and n-channel transistor is connected to the associated pixel electrode, and the gates of said p-channel transistor and n-channel transistor are connected to one of the select signals.

29. The method of claim 25 wherein said select signals comprise a bipolar pulse having at least two pulses of opposite polarities in sequence.

30. The method of claim 25 wherein the step of removing the reference voltage comprise:

applying a bipolar pulse having at least two pulses of opposite polarities in sequence to all of said select signals during said interval.

* * * * *